US012570451B2

(12) United States Patent
Merzeau et al.

(10) Patent No.: US 12,570,451 B2
(45) Date of Patent: Mar. 10, 2026

(54) ARTICLE CARRIER AND BLANK THEREFOR

(71) Applicant: WestRock Packaging Systems, LLC, Atlanta, GA (US)

(72) Inventors: Julien D. Merzeau, Châteauroux (FR); Arnaud Demange, Bristol (GB); Adriano G. Da Costa Kohler, Villefranche-sur-Saone (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/711,055

(22) PCT Filed: Nov. 22, 2022

(86) PCT No.: PCT/US2022/050789

§ 371 (c)(1),
(2) Date: May 16, 2024

(87) PCT Pub. No.: WO2023/096931

PCT Pub. Date: Jun. 1, 2023

(65) Prior Publication Data

US 2025/0026552 A1 Jan. 23, 2025

Related U.S. Application Data

(60) Provisional application No. 63/424,303, filed on Nov. 10, 2022, provisional application No. 63/404,919, (Continued)

(51) Int. Cl.
*B65D 71/46* (2006.01)

(52) U.S. Cl.
CPC .... *B65D 71/46* (2013.01); *B65D 2571/00154* (2013.01); *B65D 2571/00265* (2013.01); (Continued)

(58) Field of Classification Search
CPC ..... B65D 71/46; B65D 2571/0154; B65D 2571/00265; B65D 2571/0029; (Continued)

(56) References Cited

U.S. PATENT DOCUMENTS 5,103,971 A 4/1992 Schuster
5,503,267 A 4/1996 Suttherland

FOREIGN PATENT DOCUMENTS

DE 29511264 U1 9/1995
EP 2067713 A1 * 6/2009 ..... B65D 71/46

OTHER PUBLICATIONS

PCT/US2022/050789 International Search Report dated Jul. 17, 2023, 5 pages.

* cited by examiner

*Primary Examiner* — Bryon P Gehman
(74) *Attorney, Agent, or Firm* — Brian J. Goldberg; Rohini K. Garg; Tsugihiko Suzuki

(57) ABSTRACT

An article carrier for engaging at least one article has spaced apart panels including an engaging panel and a cover panel hingedly connected together by a side panel. The engaging panel includes at least one article retention structure having an annular series of engaging tabs and a friction flap. The friction flap is surrounded by the annular series of engaging tabs. The friction flap is coupled to the engaging panel by at least one connecting tab. The at least one connecting tab is located proximate a fold line between the engaging panel and the side panel.

20 Claims, 20 Drawing Sheets

Related U.S. Application Data filed on Sep. 8, 2022, provisional application No. 63/283,096, filed on Nov. 24, 2021.

(52) U.S. Cl.
CPC ..... *B65D 2571/0029* (2013.01); *B65D 2571/0066* (2013.01); *B65D 2571/00722* (2013.01)

(58) Field of Classification Search
CPC .. B65D 2571/0066; B65D 2571/00709; B65D 2571/00722; B65D 2571/00154; B65D 2571/00135; B65D 2571/00197; B65D 2571/00444
USPC ..... 206/429
See application file for complete search history.

ARTICLE CARRIER AND BLANK THEREFOR

CROSS-REFERENCE TO RELATED APPLICATIONS

This application claims priority to and the benefit of U.S. Provisional Application No. 63/283,096, filed Nov. 24, 2021, U.S. Provisional Application No. 63/404,919 filed Sep. 8, 2022, and U.S. Provisional Patent Application No. 63/424,303 filed Nov. 10, 2022, the entire contents of which are herein incorporated by reference in their entireties.

TECHNICAL FIELD

The present invention relates to article carriers and to blanks for forming the same. More specifically, but not exclusively, the invention relates to a carrier of the top-gripping type having one or more apertures for receiving and retaining an article therein, the carrier comprising a friction flap for frictionally engaging the article.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides an article carrier for engaging at least one article. The article carrier comprises a pair of spaced apart panels including an engaging panel and a cover panel hingedly connected together by a side panel. The article carrier comprises at least one article retention structure having an annular series of engaging tabs and a friction flap. The friction flap is surrounded by the annular series of engaging tabs. The friction flap is coupled to the engaging panel by at least one connecting tab. The at least one connecting tab is located proximate a fold line between the engaging panel and the side panel or the end panel.

Optionally, the friction flap is free of restraint by the cover panel.

Optionally, the friction flap is free of adhesive attachment to the cover panel.

Optionally, the side panel engages at least a part of the friction flap encouraging the at least one connecting tab towards or against an article in the article retention structure when in use.

Optionally, the side panel contacts the at least one connecting tab and encourages the at least one connecting tab against an article in the article retention structure.

Optionally, the article retention structure comprises an aperture surrounded by the annular series of engaging tabs.

Optionally, the friction flap comprises at least one peripheral tab.

Optionally, the at least one peripheral comprises two or more peripheral tabs.

Optionally, the at least one peripheral tab is struck from the at least one connecting tab.

Optionally, the at least one peripheral tab extends from the friction flap and interrupts the annular series of engaging tabs so as to define, at least in part, a cutaway.

Optionally, the at least one peripheral tab is defined by a non-linear cut line.

Optionally, the at least one peripheral tab is defined by a portion of an "H" shaped cut line.

Optionally, the at least one peripheral tab engages the side panel to encourage the at least one connecting tab towards an article in the article retention structure.

Optionally, the friction flap is coupled to the engaging panel by a pair of connecting tabs.

Optionally, the pair of connecting tabs is spaced apart from each other by an article engaging tab.

Optionally, the article engaging tab is defined by a portion of the "H" shaped cut line.

A second aspect of the invention provides an article carrier for engaging at least one article. The article carrier comprises an upper panel, a lower panel and a pair of locking tabs each formed from the upper panel and hinged thereto by a fold line. The fold lines are obliquely oriented with respect to a side edge of the upper panel. The locking tabs extend from the fold lines in opposite directions.

Optionally, the fold lines are disposed parallel to one another.

Optionally, the pair of locking tabs provides a retaining device securing the upper panel in position above the lower panel, at least a portion of the locking tab is disposed between the upper panel and the lower panel to maintain a spacing therebetween.

A third aspect of the invention provides an article carrier for engaging at least one article. The article carrier comprises spaced apart panels including an engaging panel and a cover panel hingedly connected together by a side panel. The article carrier comprises at least one article retention structure having a plurality of engaging tabs. The carrier comprises an end closure structure including an end panel and a top end flap hingedly connected thereto. The end closure structure comprises an article engaging feature comprising a cut line formed at least in part in the end panel. The cut line has a first width dimension and defines an engaging edge in the end panel. The end panel in the region of the engaging edge is arranged to brace against at least one of the plurality of engaging tabs of the at least one article retention structure. The at least one of the plurality of engaging tabs has an engaging edge having a second width dimension. The second width dimension is less than the first width dimension.

Optionally, the at least one of the plurality of engaging tabs is hinged to the engaging panel by a joint disposed proximate a fold line hinging the end panel to the engaging panel.

Optionally, the at least one of the plurality of engaging tabs is defined by a pair of non-linear cut lines spaced apart from the fold line hinging the end panel to the engaging panel.

Optionally, the at least one of the plurality of engaging tabs is defined by a pair of "J" shaped cut lines spaced apart from the fold line hinging the end panel to the engaging panel.

Optionally, the cut line is non-linear and defines a cover tab struck from the end panel and extending from the top end flap.

Optionally, the end panel and the at least one of the plurality of engaging tabs are arranged to be inclined with respect to the engaging panel.

A fourth aspect of the invention provides an article carrier for engaging at least one article. The article carrier comprises a tubular structure including a cover panel, an engaging panel hingedly connected together by opposed side panels. The article carrier further comprises at least one article retention structure having a plurality of engaging tabs struck from the engaging panel. The carrier further comprises a gusseted end closure structure for forming a rigid hinged connection along at least one of upper and lower end edges of at least one end of the tubular structure. The gusseted end closure structure includes a gusset provided by a pair of hinged panels connecting between a first end flap hingedly connected to the cover panel and a second end flap hingedly connected to the engaging panel. The pair of hinged panels are recessed with respect to an end edge of at least one of the first end flap and the second end flap.

Optionally, the article retention structure comprises a friction flap coupled to the engaging panel by at least one connecting tab.

Optionally, the pair of hinged panels is hingedly connected to a portion of the second end flap arranged to be substantially parallel to at least one of the cover panel and the engaging panel.

Optionally, at least one of the pair of hinged panels is defined, at least in part, by a pair of divergently arranged fold lines.

Optionally, at least one of the pair of hinged panels is defined, at least in part, by a pair of parallel fold lines.

Optionally, the cover panel comprises a pair of cover panel portions each of which is hingedly connected to the engaging panel by a respective one of the side panels.

A fifth aspect of the invention provides a blank for forming an article carrier. The blank comprises panels for forming spaced apart panels including an engaging panel, a cover panel, and a side panel hingedly connecting therebetween. The blank further comprises at least one article retention structure having an annular series of engaging tabs and a friction flap. The friction flap is surrounded by the annular series of engaging tabs. The friction flap is coupled to the engaging panel by at least one connecting tab. The at least one connecting tab is located proximate a fold line between the engaging panel and the side panel or end panel.

Optionally, the side panel is arranged to engage the at least one connecting tab in a set up condition to encourage the at least one connecting tab towards an article in the article retention structure.

A sixth aspect of the invention provides a blank for forming an article carrier. The blank comprising panels for forming spaced apart panels including an upper panel and a lower panel. The blank comprises pair of locking tabs each formed from the upper panel and hinged thereto by a fold line. The fold lines are obliquely oriented with respect to a side edge of the upper panel. The locking tabs extend from their respective fold lines in opposite directions.

A seventh aspect of the invention provides a blank for forming an article carrier. The blank comprises panels for forming spaced apart panels including an engaging panel, a cover panel, and a side panel hingedly connecting therebetween. The blank comprises at least one article retention structure having a plurality of engaging tabs. The blank further comprises an end closure structure including an end panel and a top end flap hingedly connected thereto. The end closure structure comprises an article engaging feature comprising a cut line formed at least in part in the end panel. The cut line having a first width dimension and defining an engaging edge in the end panel. The end panel in the region of the engaging edge is arranged to brace against at least one of a plurality of engaging tabs of an adjacently disposed article retention structure. The at least one of the plurality of engaging tabs has an engaging edge having a second width dimension. The second width dimension is less than the first width dimension.

An eighth aspect of the invention provides a blank for forming an article carrier. The blank comprises panels for forming a tubular structure including a cover panel an engaging panel, and a pair of opposed side panels. The blank further comprises at least one article retention structure having a plurality of engaging tabs struck from the engaging panel and a gusseted end closure structure for forming a rigid hinged connection along at least one of upper and lower end edges of at least one end of the tubular structure. The gusseted end closure structure includes a gusset provided by a pair of hinged panels connecting between a first end flap hingedly connected to the cover panel and a second end flap hingedly connected to the engaging panel. The pair of hinged panels are recessed with respect to an end edge of at least one of the first end flap and the second end flap.

A ninth aspect of the invention provides an article carrier of the top engaging type for engaging at least one article. The article carrier comprises an engaging panel comprising article retention structures and a cover panel disposed over the engaging panel and spaced apart therefrom. The cover panel comprises a first opening defined, at least in part, by a first locking tab and a second opening defined, at least in part, by a second locking tab. The first opening is spaced apart from the second opening. The first locking tab is hingedly connected to the cover panel by a first fold line and the second locking tab is hingedly connected to the cover panel by a second fold line. Each of the first and second fold lines is obliquely oriented with respect to a side edge of the cover panel. The first fold line is divergently arranged with respect to the second fold line.

Optionally, the first fold line is perpendicular to the second fold line.

Optionally, the cover panel is a composite panel formed from a pair of panels arranged in at least partial overlapping relationship with each other.

Optionally, one of the pair of panels comprises the first locking tab and the second locking tab.

Optionally, the other one of the pair of panels comprises a receiver opening for receiving a respective one of the first and second locking tabs.

Optionally, each receiver opening is defined, at least in part, by a receiver tab each hingedly connected to the other one of the pair of panels by a respective one of a pair of fold lines and wherein a first one of the pair of fold lines is divergently arranged with respect to a second one of the pair of fold lines.

Optionally, each of the pair of fold lines is obliquely oriented with respect to a side edge of the other one of the pair of panels.

A tenth aspect of the invention provides a blank for forming an article carrier. The blank comprises a plurality of panels for forming an engaging panel, comprising article retention structures, and a cover panel disposed over the engaging panel and configured to be spaced apart therefrom. The cover panel comprises a first opening defined, at least in part, by a first locking tab and a second opening defined, at least in part, by a second locking tab. The first opening is spaced apart from the second opening. The first locking tab is hingedly connected to the cover panel by a first fold line and the second locking tab is hingedly connected to the cover panel by a second fold line. Each of the first and second fold lines is obliquely oriented with respect to a side edge of the cover panel. The first fold line is divergently arranged with respect to the second fold line.

An eleventh aspect of the invention provides an article carrier and a blank for forming the same, the article carrier having an engaging panel comprising two or more article retention structures. The engaging panel has a pair of opposed side edges and a pair of end edges. The two or more article retention structures each have an article receiving opening including an annular series of engaging teeth. Each of the two or more article retention structures comprises a friction flap surrounded by the annular series of engaging teeth. Each friction flap is coupled to the engaging panel by at least one connecting tab. The at least one connecting tab of the two or more article retention structures is disposed about the respective article receiving opening such that all the friction flaps of the two or more article retention structures fold in the same direction.

Optionally, the friction flaps of the two or more article retention structures fold towards the same side or end edge of the engaging panel.

Optionally, the engaging panel has a longitudinal axis y and a transverse axis x and the two or more article retention structures are disposed in a linear series parallel to one of the longitudinal axis y and a transverse axis x.

Optionally, the at least one connecting tab is disposed at a leading edge of the article receiving opening of each of the two or more article retention structures when being conveyed in a packaging machine.

A twelfth aspect of the invention provides an article carrier and a blank for forming the same, the article carrier having an engaging panel comprising two or more article retention structures. The two or more article retention structures each have an article receiving opening including an annular series of engaging teeth. Each of the two or more article retention structures comprises a friction flap surrounded by the annular series of engaging teeth. Each friction flap is coupled to the engaging panel by at least one connecting tab and comprises a proximal end and a distal end, the distal end is disposed opposite the proximal end. The proximal end is defined by the at least one connecting tab. The proximal end of the friction flap of a first one of two or more article retention structure is disposed adjacent to the distal end of the friction flap of a second one of two or more article retention structure.

The proximal end is a hinged end and a distal end is a free, unhinged end.

A thirteenth aspect of the invention provides an article carrier and a blank for forming the same, the article carrier having an engaging panel comprising two or more article retention structures. The two or more article retention structures each have an article receiving opening including an annular series of engaging teeth. At least one of the annular series of engaging teeth is defined, in part, by a pair of cutlines. Each of the pair of cutlines terminates in curvilinear cut. The curvilinear cuts are arranged to curve toward each other, converging towards each other as they extend away from the friction flap such that a terminal end of the curvilinear cut of one of the pair of cutlines extends towards the terminal end of the curvilinear cut of the other one of the pair of cutlines.

A fourteenth aspect of the invention provides an article carrier and a blank for forming the same, the article carrier having an engaging panel comprising two or more article retention structures. The two or more article retention structures each have an article receiving opening including an annular series of engaging teeth. At least one of the annular series of engaging teeth is defined, in part, by a cutline, which terminates in a curvilinear cut, and in part by a recess. The recess interrupts the annular series of engaging teeth. The curvilinear cut is arranged to curve toward the recess, converging theretoward as it extends away from the friction flap.

Further features and advantages of the present invention will be apparent from the specific embodiments illustrated in the drawings and discussed below.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
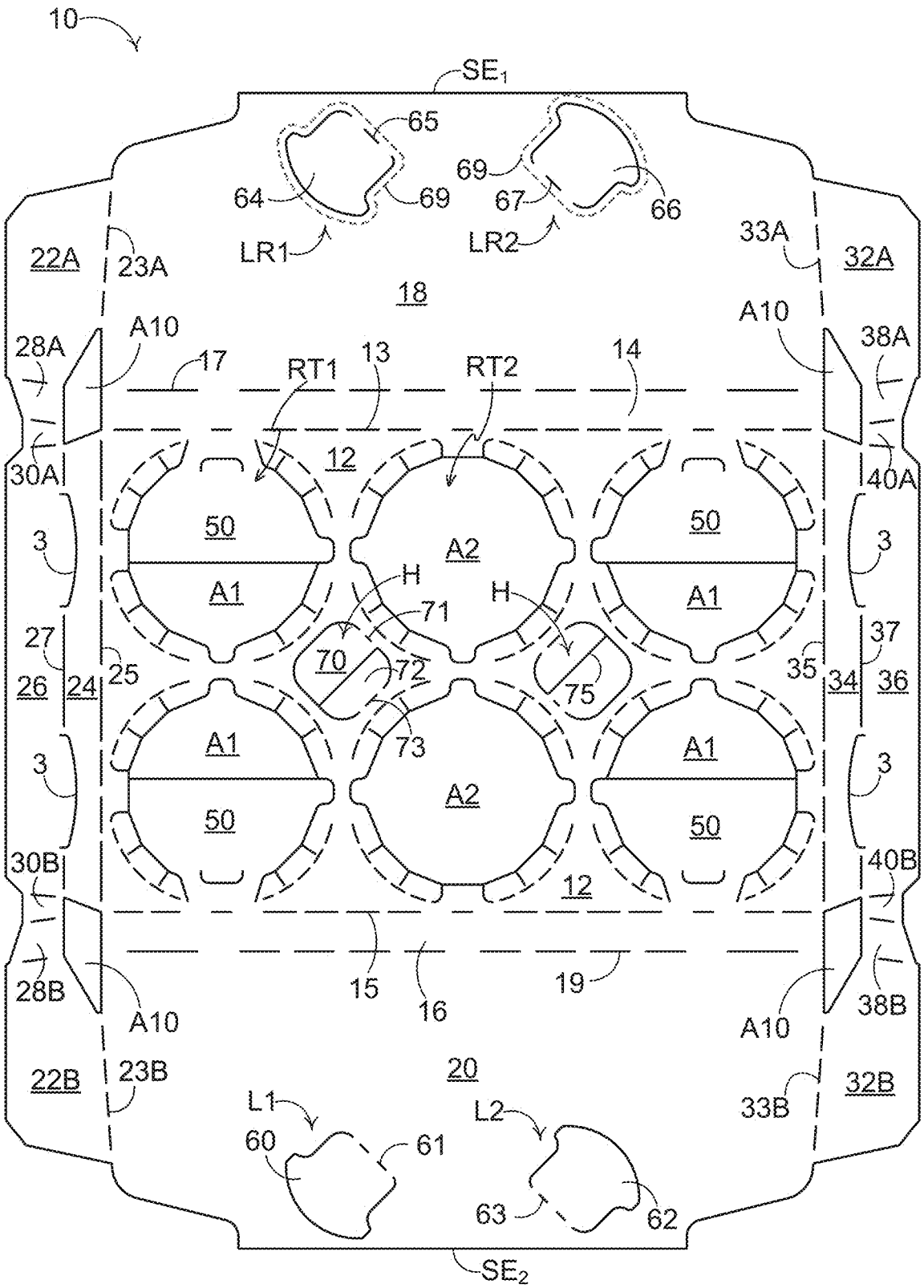
FIG. 1 is a plan view from above of a blank for forming a carrier according to a first embodiment.
Figure 4B:
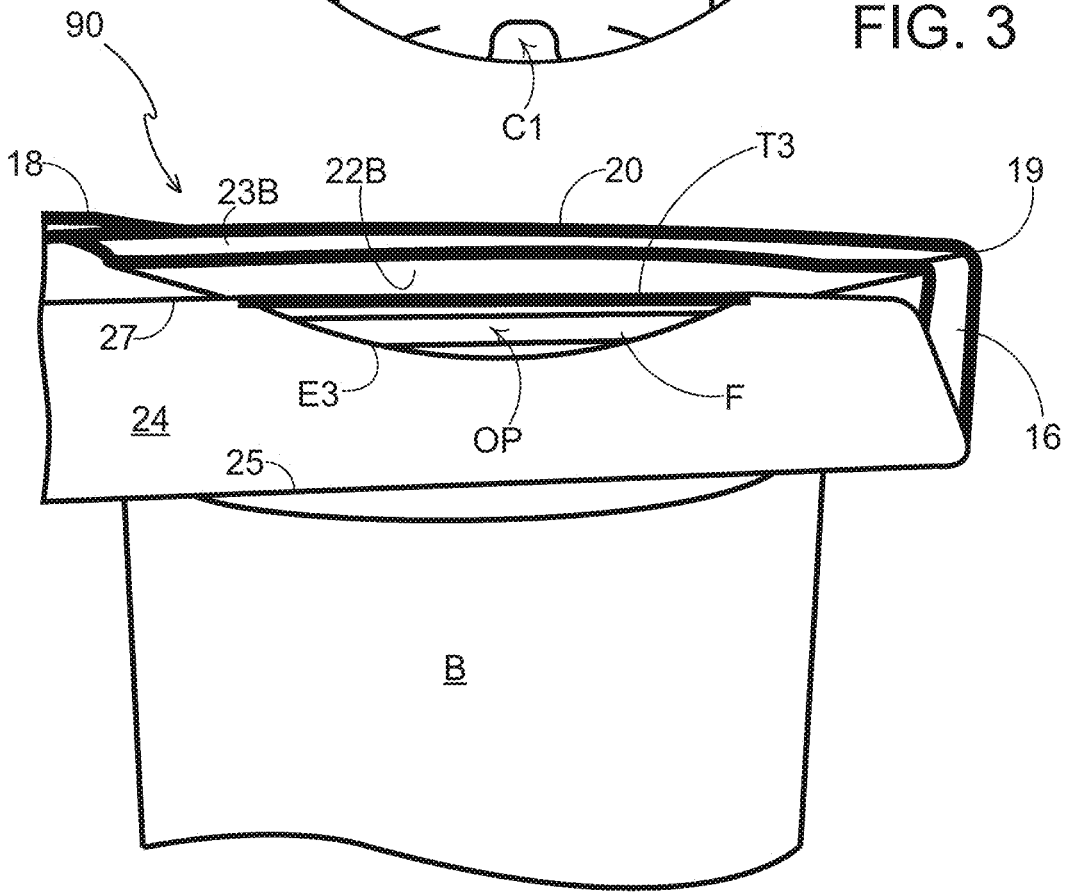
FIG. 4B is a perspective view of a portion of the carrier of FIG. 3.
Figure 4:
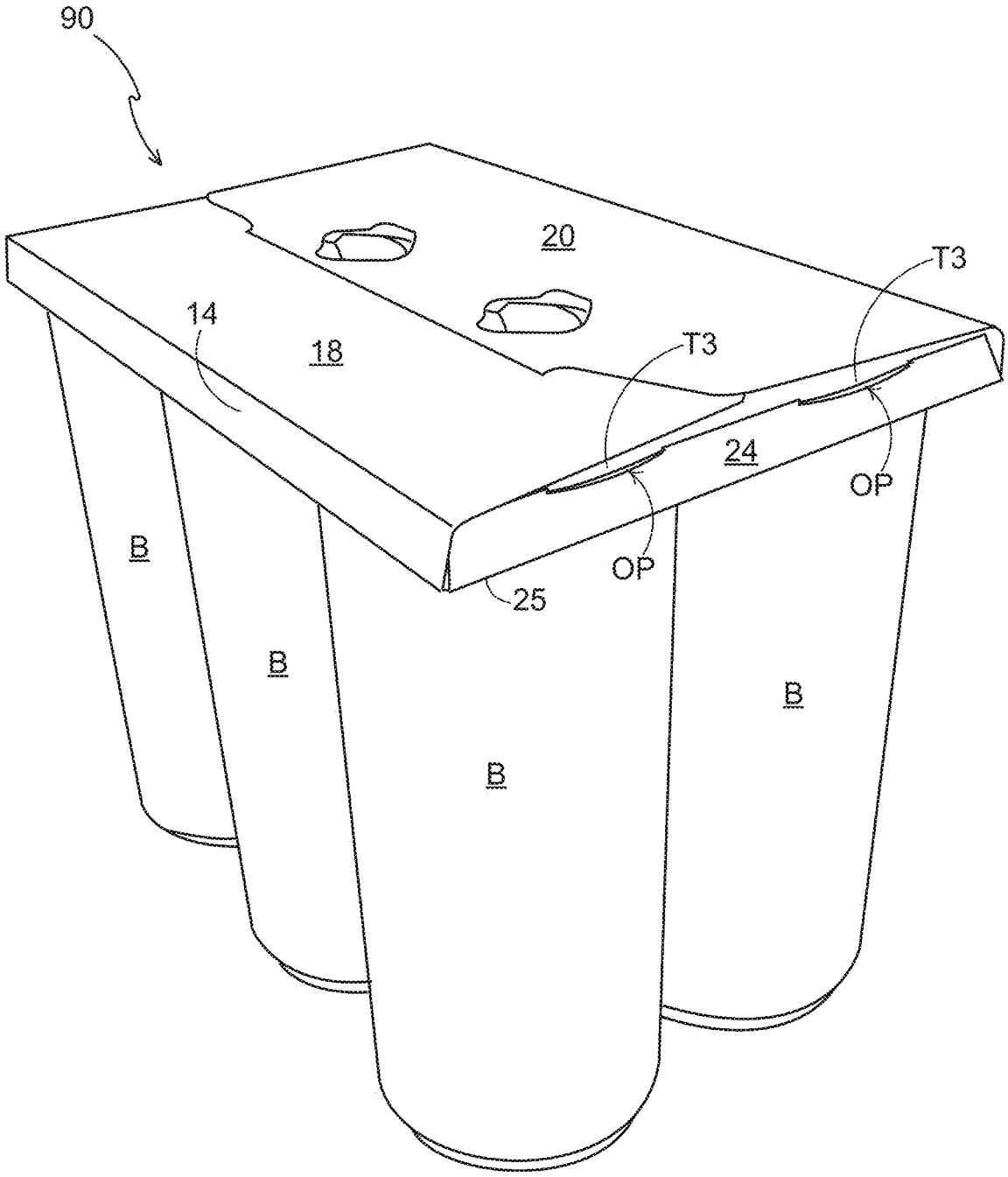
FIG. 4 is a perspective view from above of a carrier formed from the blank of FIG. 1.

Referring to FIG. 1, there is shown a plan view of a blank 10 which is capable of forming a carton or carrier 90, as shown in FIG. 4, for containing and carrying a group of primary products such as, but not limited to, bottles or cans, hereinafter referred to as articles B. The blank 10 forms a secondary package for packaging at least one primary product container or package.

Figure 9:
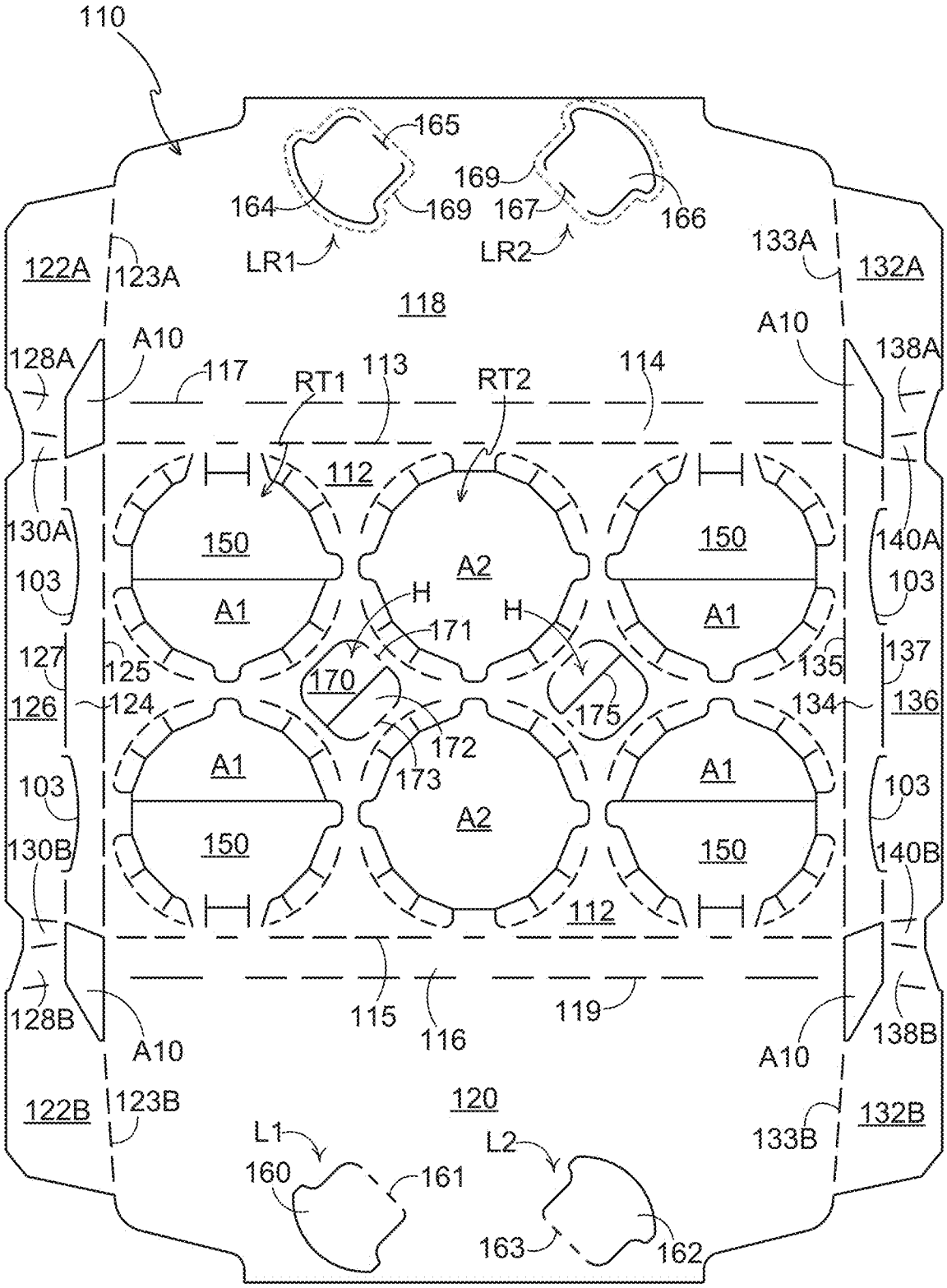
FIG. 9 is a plan view from above of a blank for forming a carrier according to a second embodiment.
Figure 10:
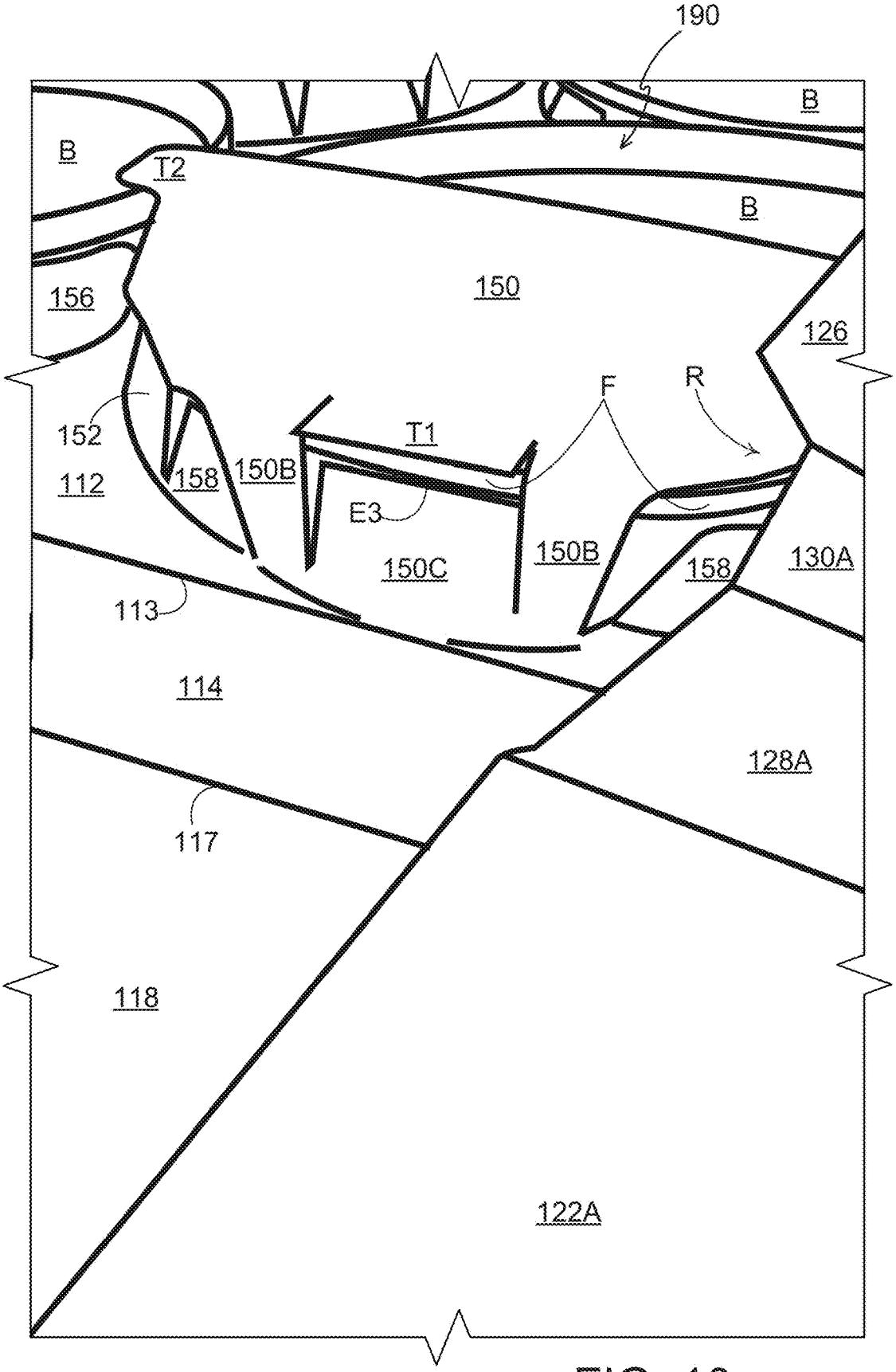
FIG. 10 illustrates a stage of construction of a package from the blank of FIG. 9.
Figure 11:
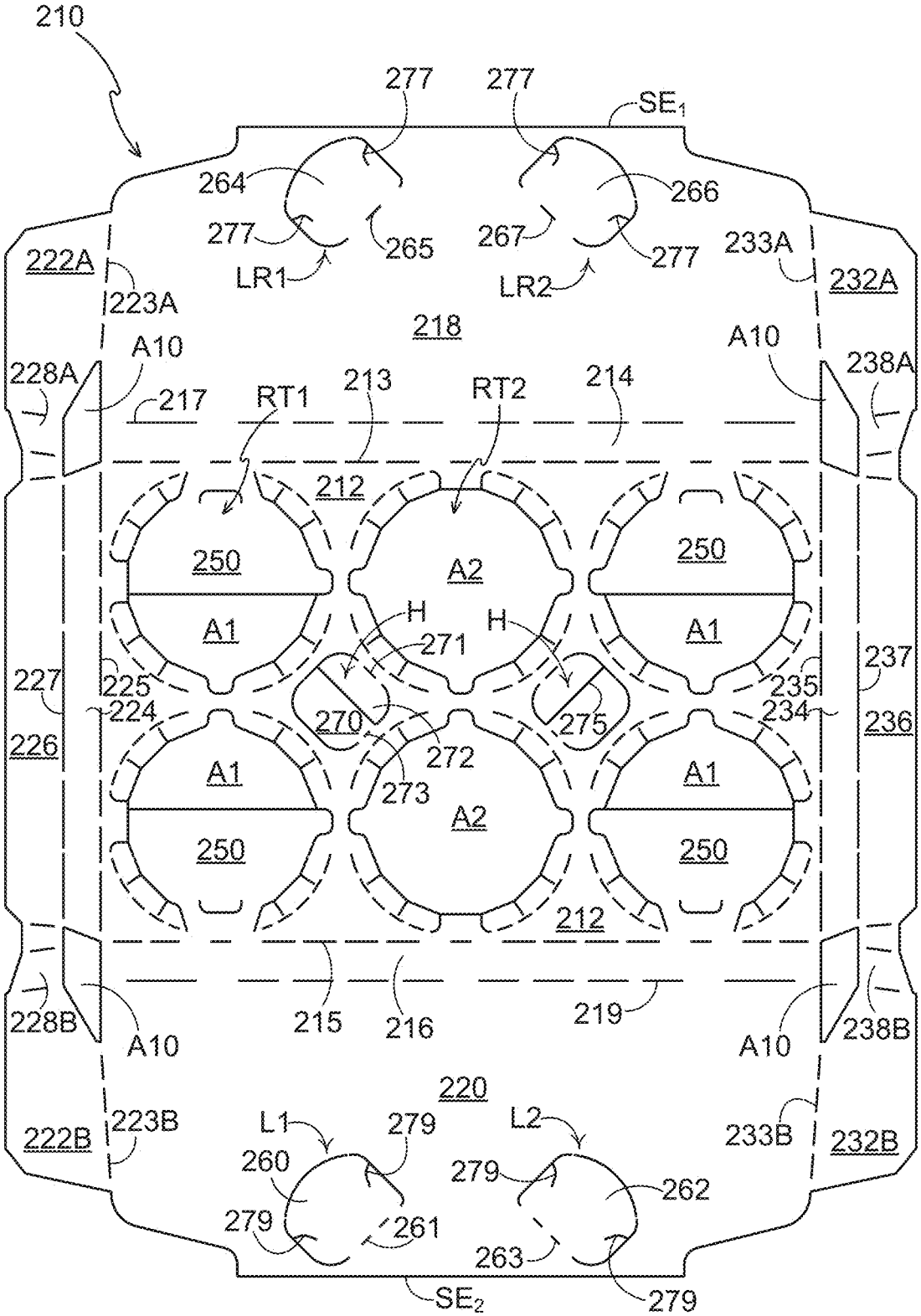
FIG. 11 is a plan view from above of a blank for forming a carrier according to a third embodiment.
Figure 12:
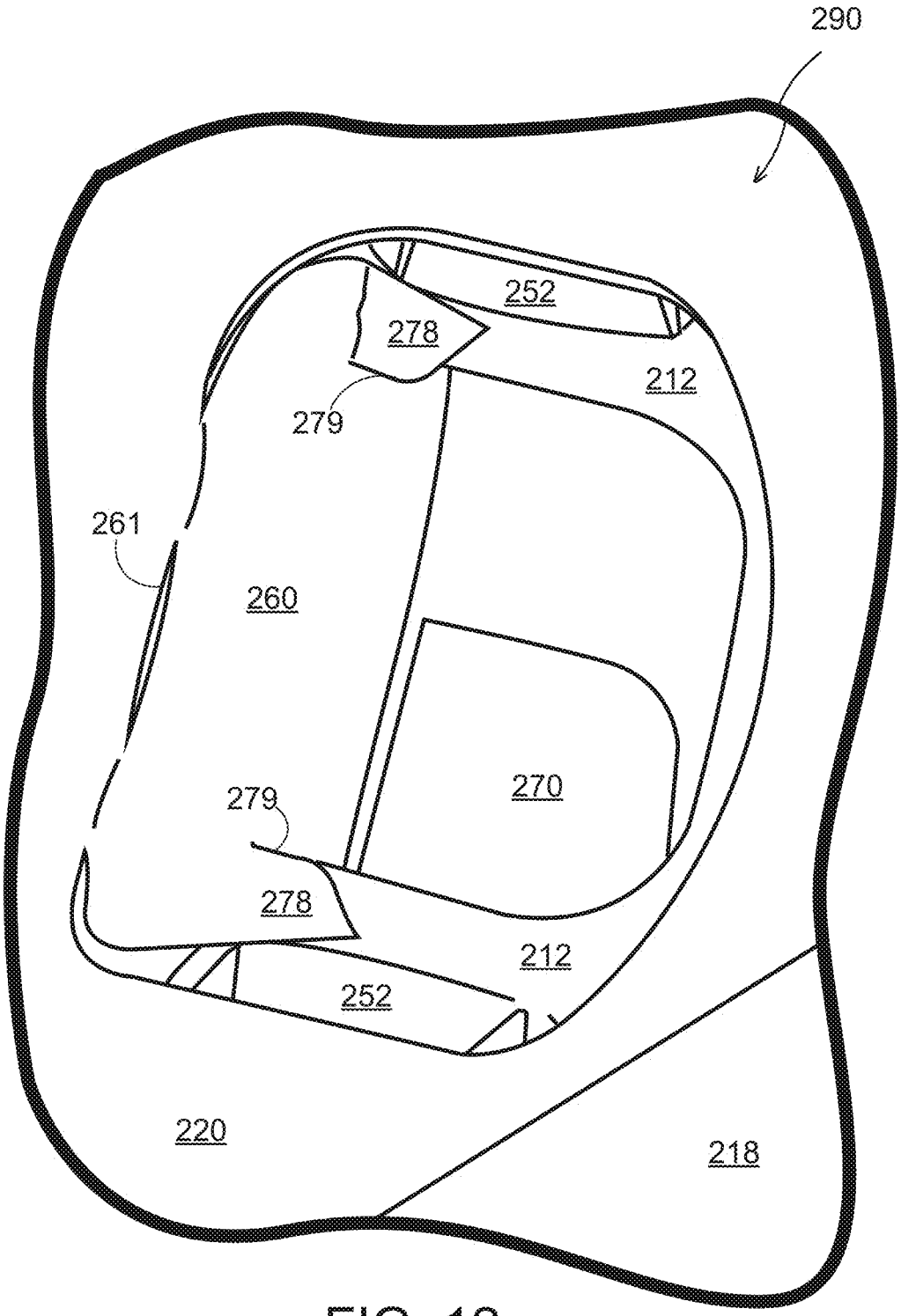
FIGS. 12 and 13 are perspective views from above of a portion of a carrier formed from the blank of FIG. 11.
Figure 17:
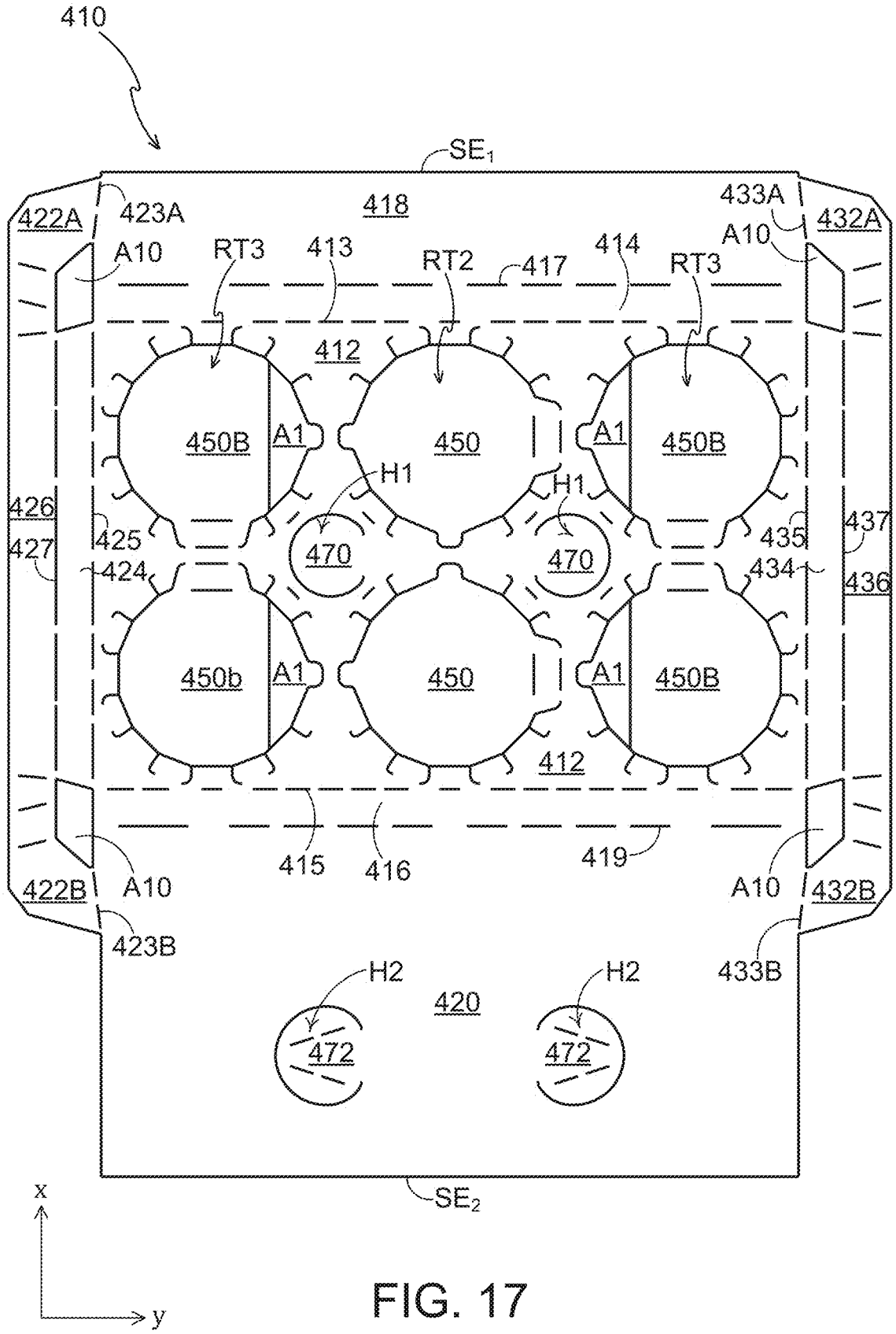
FIG. 17 is a plan view from above of a blank for forming a carrier according to a fourth embodiment.
Figure 18:
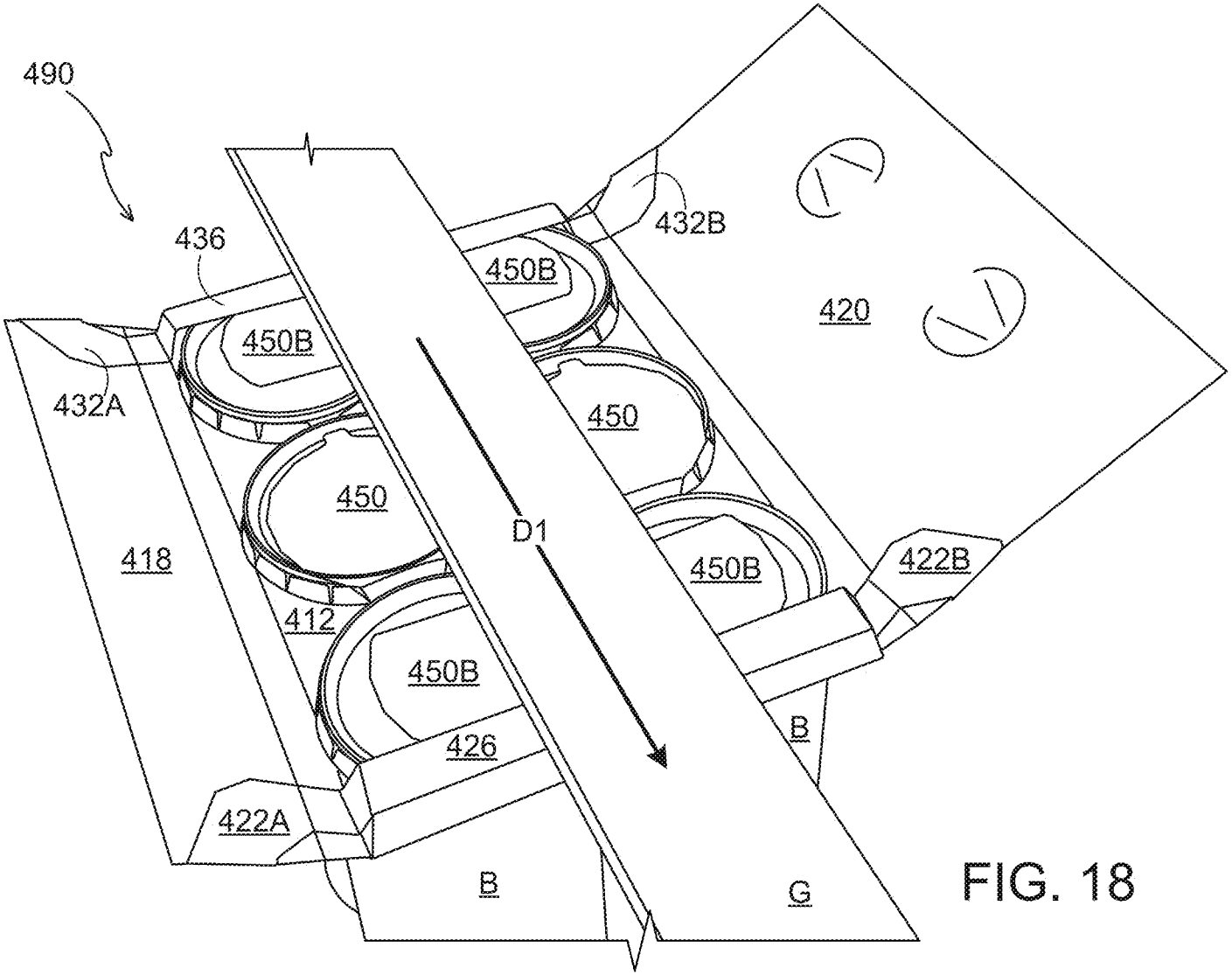
FIG. 18 illustrates a stage of construction of a package from the blank of FIG. 17.

Alternative blanks 110; 210; 310; 410 are shown in FIGS. 9, 11, 14 and 17 for forming carton or carrier 190; 290; 490, as shown in FIGS. 10, 12 and 18 respectively, for containing and carrying a group of primary products such as, but not limited to, bottles or cans, hereinafter referred to as articles B.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10; 110; 210; 310; 410 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons 90; 190; 290; 490 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210; 310; 410 are configured to form a carton or carrier 90; 190; 290; 490 for packaging an exemplary arrangement of exemplary articles B. In the illustrated embodiments, the arrangement is a 2×3 matrix or array. In the illustrated embodiments, two rows of three articles B are provided, and the articles B are 330 ml beverage cans.

Alternatively, the blanks 10; 110; 210; 310; 410 can be configured to form a carrier for packaging other types, number and size of articles and/or for packaging articles in a different arrangement or configuration.

Referring to FIG. 1 there is shown a blank 10 comprising a plurality of panels 12, 14, 16, 18, 20, including a main panel 12 for forming a lower wall or engaging panel of a carrier 90 (see FIG. 4).

A first side panel 14 is hingedly connected to a first side of the main panel 12 by a hinged connection in the form of a fold line 13. A first top or cover panel 18 is hingedly connected to the first side panel 14 by a hinged connection in the form of a fold line 17.

A second side panel 16 is hingedly connected to a second side of the main panel 12 by a hinged connection in the form of a fold line 15. A second top or cover panel 20 is hingedly connected to the second side panel 16 by a hinged connection in the form of a fold line 19.

The first top panel 18, second top panel 20, first and second side panels 14, 16 and main panel 12 form a tubular structure. Each end of the tubular structure is closed by an end closure structure. A first end closure structure comprises a first end panel 24 hingedly connected to a first end of the main panel 12 by a hinged connection in the form of a fold line 25. A first top end flap 26 is hingedly connected to the first end panel 24 by a hinged connection in the form of a fold line 27.

Figure 2:
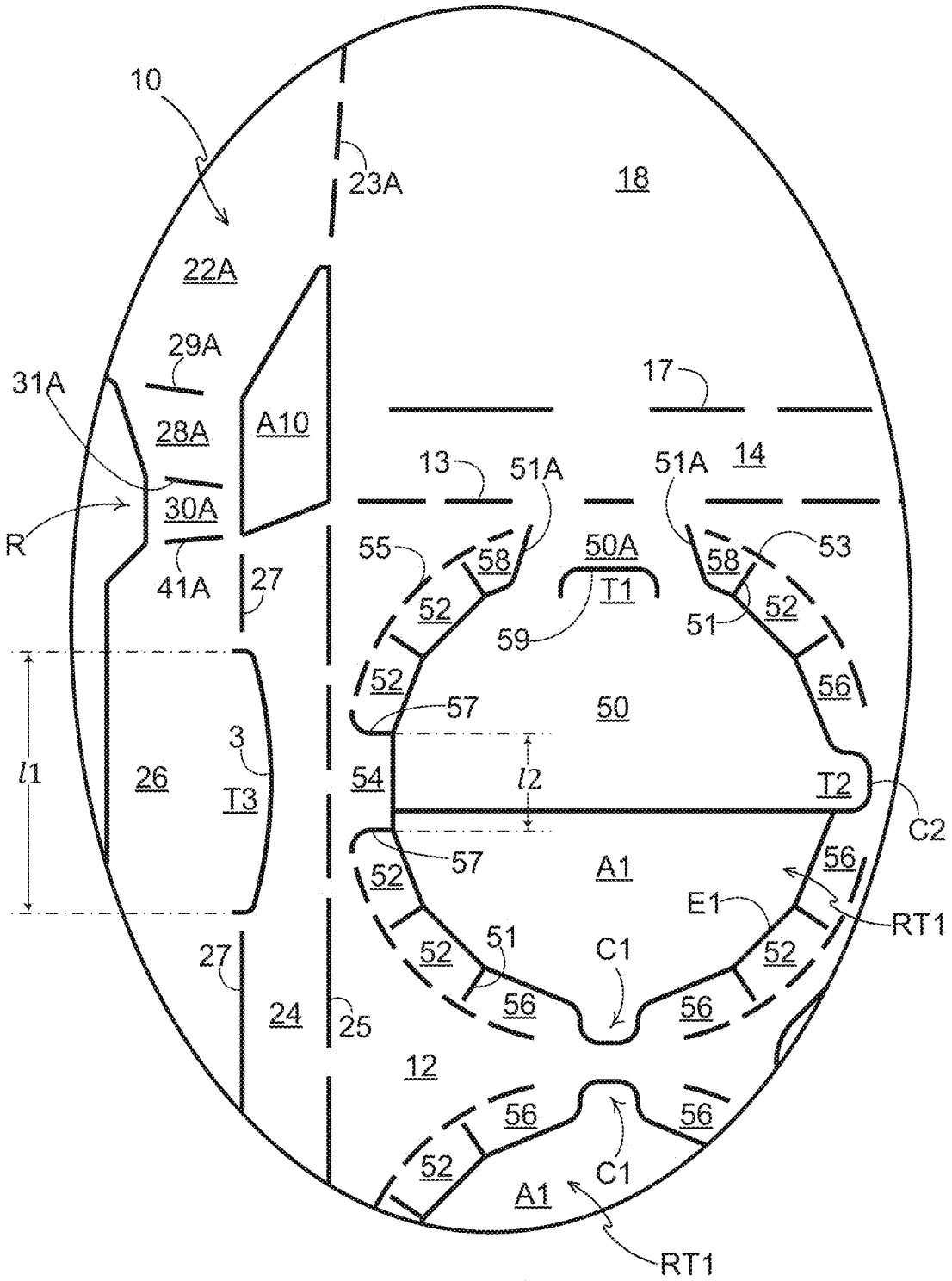
FIG. 2 is an enlarged plan view of a portion of the blank of FIG. 1.

A first anchor flap 22A is hingedly connected to a first end of the first side panel 18 by a hinged connection in the form of a fold line 23A. The first anchor flap 22A is hingedly connected to the first top end flap 26 by a pair of hinged panels 28A, 30A. The pair of hinged panels 28A, 30A form a gusset. A first connecting panel 28A is hingedly connected to the first anchor flap 22A by a hinged connection in the form of a fold line 29A, as shown in FIG. 2. A second connecting panel 30A is hingedly connected to the first connecting panel 28A by a hinged connection in the form of a fold line 31A. The second connecting panel 30A is hingedly connected to the first top end flap 26 by a hinged connection in the form of a fold line 41A.

The first connecting panel 28A and the second connecting panel 30A are inset with respect to the first anchor flap 22A and/or with respect to the first top end flap 26. A recess R, best shown in FIG. 2, is struck from an end edge of the blank 10.

A second anchor flap 22B is hingedly connected to a first end of the second side panel 20 by a hinged connection in the form of a fold line 23B. The second anchor flap 22B is hingedly connected to the first top end flap 26 by a pair of hinged panels 28B, 30B forming a second gusset. A third connecting panel 28B is hingedly connected to the second anchor flap 22B by a hinged connection in the form of a fold line. A fourth connecting panel 30B is hingedly connected to the third connecting panel 28B by a hinged connection in the form of a fold line. The fourth connecting panel 30B is hingedly connected to the first top end flap 26 by a hinged connection in the form of a fold line.

The first end panel 24 is separated from each of the first and second anchor flaps 22A, 22B by an aperture A10. The apertures A10 separate each of the pair of hinged panels 28A/30A, 28B/30B from the respective one of the first and second side panels 14, 16.

A second end closure structure comprises a second end panel 34 hingedly connected to a second end of the main panel 12 by a hinged connection in the form of a fold line 35. A second top end flap 36 is hingedly connected to the second end panel 34 by a hinged connection in the form of a fold line 37.

A third anchor flap 32A is hingedly connected to a second end of the first side panel 18 by a hinged connection in the form of a fold line 33A. The third anchor flap 32A is hingedly connected to the second top end flap 36 by a pair of hinged panels 38A, 40A forming a third gusset. A fifth connecting panel 38A is hingedly connected to the third anchor flap 32A by a hinged connection in the form of a fold line. A sixth connecting panel 40A is hingedly connected to the fifth connecting panel 38A by a hinged connection in the form of a fold line. The sixth connecting panel 40A is hingedly connected to the second top end flap 36 by a hinged connection in the form of a fold line.

A fourth anchor flap 32B is hingedly connected to a second end of the second side panel 20 by a hinged connection in the form of a fold line 33B. The fourth anchor flap 32B is hingedly connected to the second top end flap 36 by a pair of hinged panels 38B, 40B forming a fourth gusset. A seventh connecting panel 38B is hingedly connected to the fourth anchor flap 32B by a hinged connection in the form of a fold line. An eighth connecting panel 40B is hingedly connected to the seventh connecting panel 38B by a hinged connection in the form of a fold line. The eighth connecting panel 40B is hingedly connected to the second top end flap 36 by a hinged connection in the form of a fold line.

The second end panel 34 is separated from each of the third and fourth anchor flaps 32A, 32B by an aperture A10. The apertures A10 separate each of the pair of hinged panels 38A/40A, 38B/40B from the respective one of the first and second side panels 14, 16.

The main panel 12 of the blank 10 includes at least one article retention structure RT1, RT2. The main panel 12 comprises a plurality of article retention structures RT1, RT2, specifically six article retention structures RT1, RT2 arranged in 2×3 matrix or array. Each of the article retention structures RT1, RT2 comprises an opening or aperture A1, A2.

The article retention structures RT1, RT2 of the embodiment of FIG. 1 take the form of a plurality of teeth or tabs 52, 54, 56, 58 arranged in an annular series and form part of an article receiving opening.

The plurality of teeth 52, 54, 56, 58 are provided by the main panel 12. Each of the teeth 52, 54, 56, 58 comprises a hinged connection. The hinged connection may be defined by a plurality of cut lines 53, 55. The plurality of cut lines 53, 55 may be arranged as an annular series of cuts about the article receiving opening.

The plurality of cut lines 53, 55 may define or approximate a portion of circle.

Figure 3:
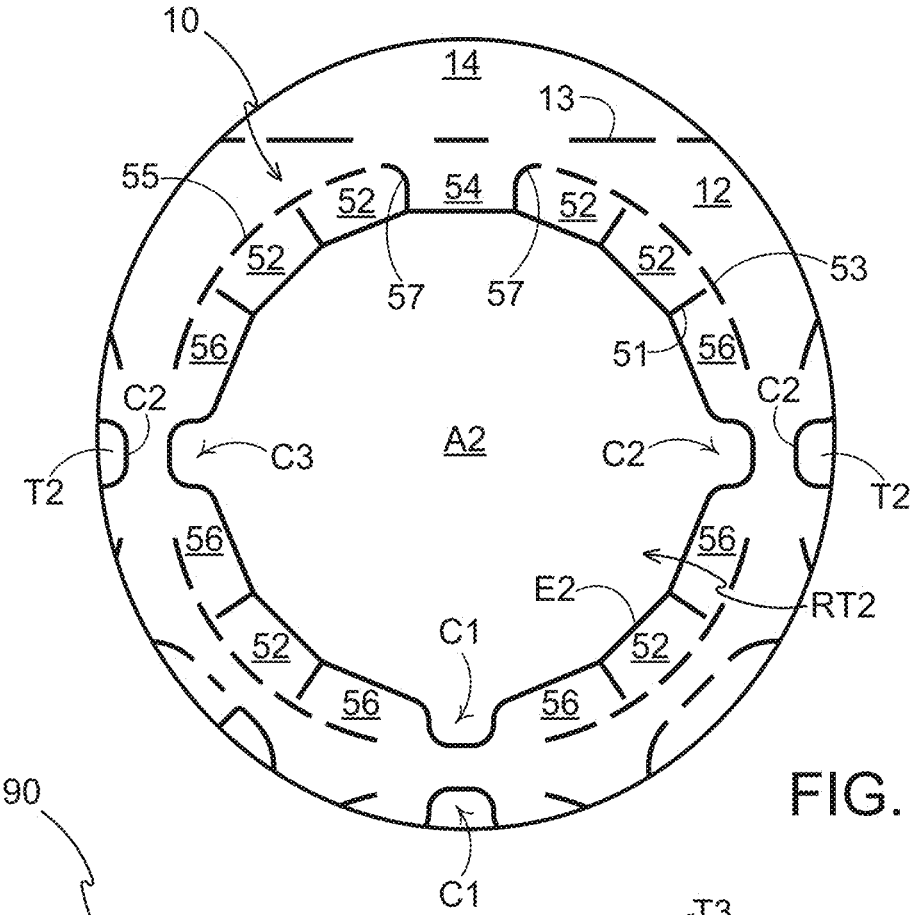
FIG. 3 is an enlarged plan view of another portion of the blank of FIG. 1.

Each of the plurality of teeth 52, 54, 56, 58 comprises an engaging edge E1, E2, see FIGS. 2 and 3, opposing a hinged edge. The engaging edges E1, E2 are defined by a linear portion of a cut line defining a first aperture A1, the friction flap 50 or a second aperture A2. Each engaging edge E1, E2 may define a part of a polygon. The illustrated embodiment comprises thirteen teeth 52, 54, 56, 58 together defining a part of a polygon. Each tooth 52, 54, 56, 58 comprises a pair of side edges, the side edges are defined by cuts 51, 57 extending radially outward from respective vertices of the polygon, that is to say, from a respective vertex between a pair of adjacent linear portions of the cut defining the portion of the polygon. The cuts 51, 57 are divergently arranged with respect to each other and define an angle therebetween.

The article retention structures RT1, RT2 comprise a plurality of first circumferential cut lines 53. Each of the plurality of first circumferential cut lines 53 is aligned with one of the radial cut lines 51 such that said one of the radial cut lines 51 or a notional extension thereof bisects a respective one of the plurality of first circumferential cut lines 53.

Each of the plurality of first circumferential cut lines 53 is spaced apart from said one of the radial cut lines 51 bisecting it so as to define a connecting nick or bridge portion between a pair of adjacently disposed teeth 52, 56, 58.

Each of the plurality of first circumferential cut lines 53 may be linear in shape.

The article retention structures RT1, RT2 comprise a plurality of second circumferential cut lines 55. Each of the plurality of second circumferential cut lines 55 is disposed between a pair of the plurality of first circumferential cut lines 53 and is spaced apart therefrom so as to define a pair of connecting nick or bridge portions between each tooth 52, 56, 58 and the main panel 12. The pair of connecting nick or bridge portions provide a hinged or foldable connection between each tooth 52, 56, 58 and the main panel 12.

Each of the plurality of second circumferential cut lines 55 may be linear in shape.

In alternative embodiments, each of the plurality of first circumferential cut lines 53 may be arcuate or curved. In some embodiments, each of the plurality of second circumferential cut lines 55 may be arcuate or curved.

The blank 10 comprises four endmost article retention structures RT1 each comprising a first aperture A1. The blank 10 comprises two medial or intermediate article retention structures RT2 each comprising a second aperture A2.

The endmost article retention structures RT1 comprise an article receiving opening defined in part by the first aperture A1 which is defined in, or struck from, the main panel 12 and in part by a cover or friction flap 50.

The intermediate article retention structures RT2 comprises an article receiving opening defined in part by the second aperture A2 which is defined in, or struck from, the main panel 12.

The endmost article retention structures RT1 and the intermediate article retention structures RT2 each comprises a plurality of teeth or tabs 52, 54, 56, 58, best shown in FIGS. 2 and 3. In the endmost article retention structures RT1 the plurality of teeth or tabs 52, 54, 56, 58 are arranged as an annular series disposed about the first aperture A1 and the friction flap 50. In the intermediate article retention structures RT2 the plurality of teeth or tabs 52, 54, 56, 58 are arranged as an annular series disposed about the second aperture A2.

The plurality of teeth 52, 54, 56, 58 of the endmost article retention structures RT1 are interrupted by a first recess or cutaway C1, as shown in FIG. 2. The first recess C1 is provided at a location about the circumference of the first aperture A1 disposed in closest proximity to an adjacent endmost article retention structure RT1. The first recess C1 extends from the first aperture A1 towards the first aperture A1 of the endmost article retention structure RT1.

The plurality of teeth 52, 54, 56, 58 of the endmost article retention structures RT1 are interrupted by a second recess or cutaway C2. The second recess C2 is provided at a location about the circumference of the article receiving opening disposed in closest proximity to an adjacent intermediate article retention structure RT2. The second recess C2 extends from the article receiving opening towards the adjacent intermediate article retention structures RT2. The second recess C2 is defined, at least in part by a second peripheral tab T2, extending from or integral with the friction flap 50.

The endmost article retention structures RT1 comprise a plurality of first teeth 52 or engaging tabs 52 for supporting or suspending an article B.

The endmost article retention structures RT1 comprise a second tooth or engaging tab 54 which is disposed proximate the hinged connection between the engaging panel 12 and a respective one of the first and second end panels 24, 34. The second tooth 54 may be integral with the engaging panel 12, that is to say it is free from any fold lines, 53, 55 or hinged connection to the engaging panel 12. The second tooth 54 is in sufficiently close proximity to one of the fold lines 25, 35 hinging the first and second end panels 24, 34 to the engaging panel 12 that a respective one of the fold lines 25, 35 effectively serves as a hinged connection to the second tooth 54. The second tooth 54 may be defined by cuts 57 which comprise a 'J' or 'C' shaped cut proximate said one of the fold lines 25, 35. A portion of the 'J' or 'C' shaped cut may lie upon a notional circle defined by the plurality of cut lines 53, 55. The second tooth 54 is disposed opposite the second recess C2.

The endmost article retention structures RT1 comprise a third tooth or tab 50A, also referred herein as connecting tab 50A which is disposed proximate the hinged connection between the engaging panel 12 and a respective one of the first and second side panels 14, 16. The third tab 50A is coupled to, or integral with the friction flap 50. The third tooth or tab 50A may be defined in part by a cut lines 51A. The cut lines 51A may be obliquely oriented with respect to a respective one of the fold lines 13, 15 hinging the first and second side panels 14, 16 to the main panel 12. The cut lines 51A may be arranged to be divergently oriented with respect to each other as they approach the friction flap 50. In this way a portion of the third tab 50A proximate the friction flap 50 is wider than a portion of the third tab 50A proximate the respective one of the first and second side panels 14, 16. The third tab 50A may be defined, at least in part, by a cut line 59 separating a portion of the third tab 50A from the friction flap 50. The cut line 59 may be nonlinear and may be substantially "U" shaped so as to define a first peripheral tab T1. The first peripheral tab T1 may be struck, at least in part, from material which would otherwise form the third tab 50A, such that the first peripheral tab T1 extends beyond a hinged connection between the third tab 50A and the friction flap 50, best illustrated in FIG. 5. The third tooth 50A is disposed opposite the first recess C1.

In a folded or assembled carrier 90, the first peripheral tab T1 may engage or contact a side panel 14, 16; said side panel 14, 16 applying a force to the first peripheral tab T1 which encourages the third tab 50A towards or against the article B.

The third tooth or tab 50A may be flanked by a partial tooth or tab 58 on each side thereof.

The first and second recesses C1, C2 may be flanked by a fourth tooth or tab 56 on each side thereof. The fourth tooth or tab 56 may occupy a greater circumferential distance than the first teeth 52.

The intermediate article retention structures RT2 are similar in construction to the endmost article retention structures RT1, albeit the cover or friction flap 50 has been omitted. In alternative embodiments, the intermediate article retention structures RT2 may comprise a cover or friction flap 50 similar to that of the endmost article retention structures RT1. The intermediate article retention structures RT2 do not comprise any partial teeth 58 or the connecting tab 50A.

The intermediate article retention structures RT2 comprise a plurality of first teeth 52 or engaging tabs 52 for supporting or suspending an article B.

The intermediate article retention structures RT2 comprise a second tooth or engaging tab 54 which is disposed proximate the hinged connection between the engaging panel 12 and a respective one of the first and second side panels 14, 16. The second tooth 54 may be integral with the engaging panel 12, that is to say it is free from any fold lines, 53, 55 or hinged connection to the engaging panel 12. The second tooth 54 is in sufficiently close proximity to one of the fold lines 13, 15 hinging the first and second side panels 14, 16 to the engaging panel 12 that a respective one of the fold lines 13, 15 effectively serves as a hinged connection to the second tooth 54. The second tooth 54 may be defined by cuts 57 which comprise a 'J' or 'C' shaped cut proximate said one of the fold lines 25, 35. A portion of the 'J' or 'C' shaped cut may lie upon a notional circle defined by the plurality of cut lines 53, 55.

The plurality of teeth 52, 54, 56 of the intermediate article retention structures RT2 are interrupted by a first recess or cutaway C1, as shown in FIG. 3. The first recess C1 is provided at a location about the circumference of the second aperture A2 disposed in closest proximity to an adjacent intermediate article retention structure RT2. The first recess C1 extends from the second aperture A2 towards the second aperture A2 of the intermediate article retention structures RT2. The second tooth 54 is disposed opposite the first recess C1.

The plurality of teeth 52, 54, 56, 58 of the intermediate article retention structures RT2 are interrupted by a second and third recesses or cutaways C2, C3. The second recess C2 is provided opposite the third recess C3. The second and third recesses or cutaways C2, C3 are provided at locations about the circumference of the article receiving opening disposed in closest proximity to respective ones of the adjacent endmost article retention structures RT1.

The second recess C2 extends from the article receiving opening towards a first adjacent article retention structure RT1. The third recess C3 extends from the article receiving opening towards a second adjacent article retention structure RT1.

The first, second, and third recesses C1, C2, C3 may be flanked by a fourth tooth or tab 56 on each side thereof. The fourth tooth or tab 56 may occupy a greater circumferential distance than the first teeth 52.

The main panel 12 comprises a handle structure H. The handle structure H may comprise at least one handle opening. In the illustrated embodiment, the blank 10 comprises two handle openings. Each handle opening is defined in, or struck from, a region of the main panel 12 disposed centrally between four apertures A1, A2 arranged as two adjacent pairs of apertures A1, A2. Each handle opening may be defined, at least in part, by one or more handle flaps 70, 72. In the illustrated embodiment, the handle openings are defined by a pair of handle flaps 70, 72. The pair of handle flaps 70, 72 includes a first, major, handle flap 70 and a second, minor, handle flap 72, the minor handle flap 72 being smaller than the major handle flap 70. The first handle flap 70 is hingedly connected to the main panel 12 by a first fold line 71 and the second handle flap 72 is hingedly connected to the main panel 12 by a second fold line 73. The handle opening may be substantially square or diamond shaped. The second fold line 73 may be disposed adjacent to the first fold line 71, and may be separated therefrom by an arcuate cut line, defining a rounded corner of the handle opening.

The first and second top panels 18, 20 are arranged to be disposed in at least partially overlapping relationship with each other. The overlapping portions of the first and second top panels 18, 20 are provided with a locking structure for locking the first and second top panels 18, 20. The locking structure cooperates with the handle openings in the main panel 12 to secure the first and second top panels 18, 20 to the main panel 12.

The locking structure comprises at least one receiver LR1, LR2 in the form of an opening in the first top panel 18. The first top panel 18 comprises a plurality of openings, more specifically two openings, although in other embodiments one or more openings may be provided. Each of the openings is arranged to be in vertical registry or alignment with a handle opening provided in the main panel 12. The openings may be defined by at least one tab 64, 66 (also referred to herein as female tabs or receiver tabs). In the illustrated embodiment, each opening is defined by a single tab 64, 66.

A first receiver tab 64 is hinged to the first top panel 18 by a first hinged connection in the form of a first fold line 65 and forms part of a first receiver LR1. A second receiver tab 66 is hinged to the first top panel 18 by a second hinged connection in the form of a second fold line 67 and forms part of a second receiver LR2. The second receiver tab 66 is hinged to the first top panel 18 in opposition to the first receiver tab 64. The fold lines 65, 67 are obliquely oriented with respect to a free side edge $SE_1$ of the first top panel 18. The fold lines 65, 67 are obliquely oriented with respect to the tubular axis of the tubular structure formed at least by the first top panel 18, the second top panel 20, the first and second side panels 14, 16 and the main panel 12. In FIG. 1, the fold line 17 which hinges the first top panel 18 to the first side panel 14 extends along the tubular axis. As such, the fold lines 65, 67 are obliquely oriented with respect to the fold line 17. Each handle opening may comprise a fold or crease line 69 surround the tab 64, 66. The crease line being shaped complementarily to the tab 64, 66, that is to say it follows the contour of the tab 64, 66.

The locking structure comprises at least one locking element L1, L2 for being received in the receiver LR1, LR2. The locking element L1, L2 comprises a tab 60, 62 struck from the second top panel 20, the illustrated embodiment comprises two tabs 60, 62 each arranged to be engageable with one of the receiver openings and a respective one of the handle openings. Each tab 60, 62 is hinged to the second top panel 20 by a respective hinged connection 61, 63.

The tab 60, 62 may be substantially 'arrowhead' shaped so as to define a pair of opposing shoulders or detents for securely engaging the handle opening and/or receiver LR1, LR2.

Each of the locking elements L1, L2 is arranged to be in vertical registry or alignment with a handle opening provided in the main panel 12 and with one of the receiver openings provided in the first top panel 18. The locking elements L1, L2 are defined by one of the two tabs 60, 62 (also referred to herein as male tabs or locking tabs). In the illustrated embodiment, each locking element L1, L2 is defined by a single locking tab 60, 62.

A first locking tab 60 is hinged to the second top panel 20 by a first hinged connection in the form of a first fold line 61 and forms part of a first locking element L1. A second locking tab 62 is hinged to the second top panel 20 by a second hinged connection in the form of a second fold line 63 and forms part of a second locking element L2. The second locking tab 66 is hinged to the second top panel 20 in opposition to the first locking tab 64. The fold lines 61, 63 are obliquely oriented with respect to the tubular axis of the tubular structure formed at least by the first top panel 18, the second top panel 20, the first and second side panels 14, 16 and the main panel 12. In FIG. 1, a free side edge $SE_2$ of the second top panel 20 and the fold line 19 each is parallel to the tubular axis. As such, the fold lines 61, 63 are obliquely oriented with respect to either one of the free side edge $SE_2$ and the fold line 19 hinging the second top panel 20 to the second side panel 16.

The first and second end closure structures may comprise at least one article engaging structure. In the illustrated embodiment, each of the first and second end closure structures comprises a pair of article engaging structures. Each article engaging structure is defined at least in part by a cut line 3. The cut line 3 may be non-linear. In the illustrated embodiment, the cut line 3 is substantially "C" or "U" shaped. The cutline 3 is struck from, or defined in, a respective one of the first and second end panels 24, 34. The cutline 3 may interrupt a respective one of the fold lines 27, 37 hinging a top end flap 26, 36 to one of the first and second end panels 24, 34. The cut line 3 defines, at least in part a cover tab T3 struck or formed from material which would otherwise form part of one of the first and second end panels 24, 34. The cover tab T3 is integral with one of the first and second top end flaps 26, 36.

In a folded condition, the cutline 3 forms or defines, in part an article engaging opening OP, see FIGS. 4 and 4B. The opening engages or receives a part of an article B, the article B may comprise a flange or chime F which is received in part in the article engaging opening OP.

The cut line 3 defines an edge E3 of the article engaging opening OP. The cut line 3, edge E3 or article engaging opening OP comprises linear dimension or width l1. The width l1 is greater than the width or linear dimension l2 of the engaging edge E1 of the second tooth 54. In this way a portion of the end panel 24, 34 reinforces, braces or secures the second tooth 54 against the article B. The second tooth 54 is supported or braced along the entirety of its engaging edge E1 by said portion of the end panel 24, 34.

Each article engaging structure may increase the grip of the article carrier 90 on the article B it engages; it may increase the friction between the article carrier 90 and the article B.

Turning to the construction of the carrier 90 from the blank 10, the blank 10 may be formed into an assembled carrier 90, as shown in FIG. 3.

The blank 10 is applied to a group of articles B. The blank 10 is lowered with respect to a group of articles B. Each of the article retention structures RT1, RT2 of the blank 10 is aligned with a respective article B in the group. Portions of the articles B pass through the main panel 12. The toothed regions of the main panel 12 about each of the article retention structures RT1, RT2 may be folded out of the plane of the main panel 12.

Each toothed region of the main panel 12 may be folded about one of the articles B received in the respective one of the article retention structures RT1, RT2.

The engaging edges of the teeth 52, 54, 56, 58 engage beneath a projection. The projection may be located about the neck or chime of the article B (which may provide a flange F) of an article B. When the article B is a can, the projection may be provided by a canner's end seam. In other embodiments, it may be provided by a ridge or undercut shaping of the article B or by an end closure of the article B; for example, but not limited to, a crown cork or closure. In this way, the engaging edges grip or hold the article B and prevent or inhibit the article B from unintentionally separating from the main panel 12.

Figure 7:
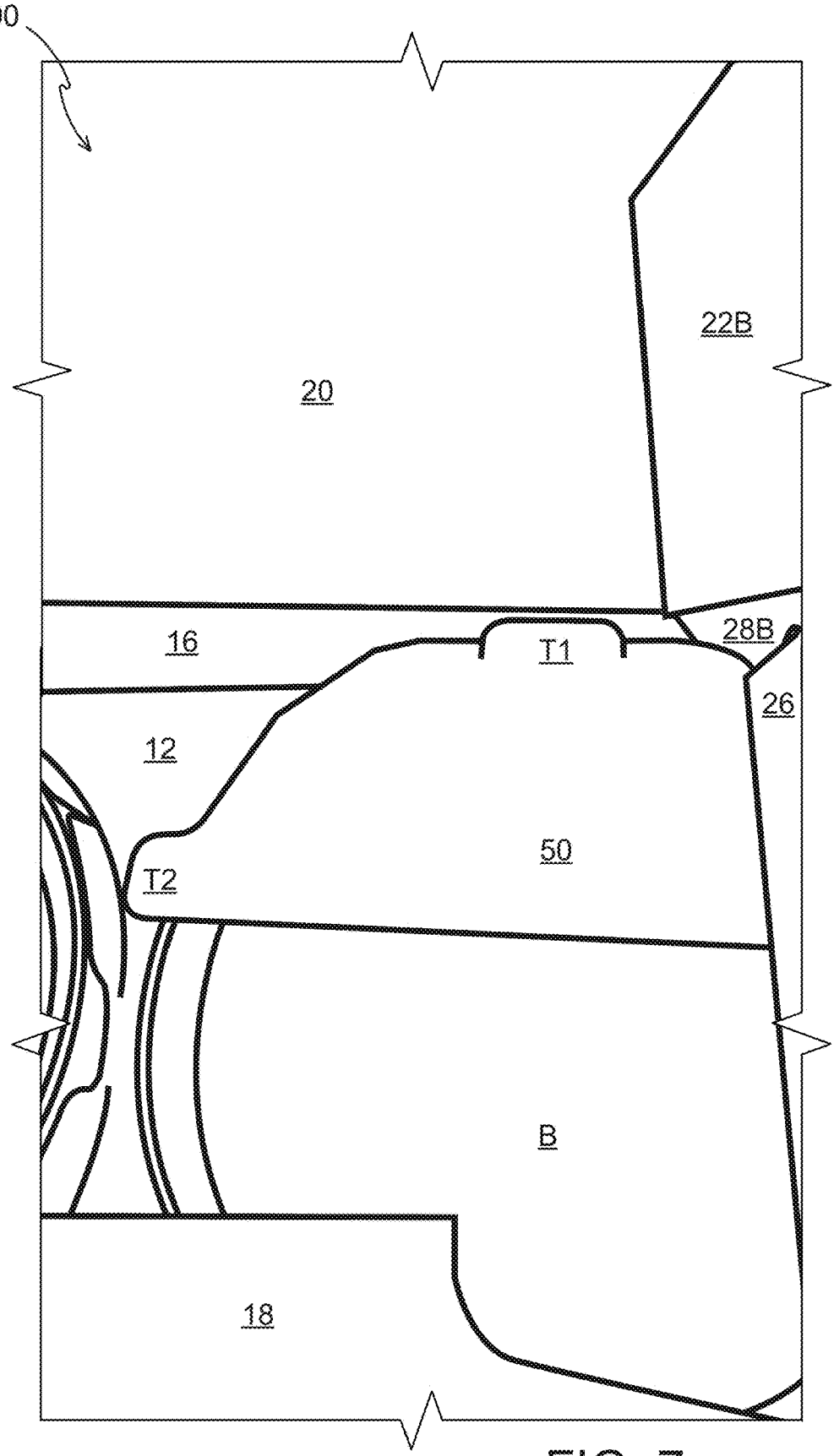

The friction flaps 50 are displaced out of the plane of the main panel 12, each third tooth 50A is folded of the plane of the main panel 12. The friction flaps 50 are folded, with respect to the third tooth 50A to which it is connected, at least partially over an upper end of an article B, as shown in FIG. 7. The first peripheral tab T1 and the second peripheral tab T2 are disposed over or on top of a rim or chime of the article B, best shown in FIG. 7.

Figure 5:
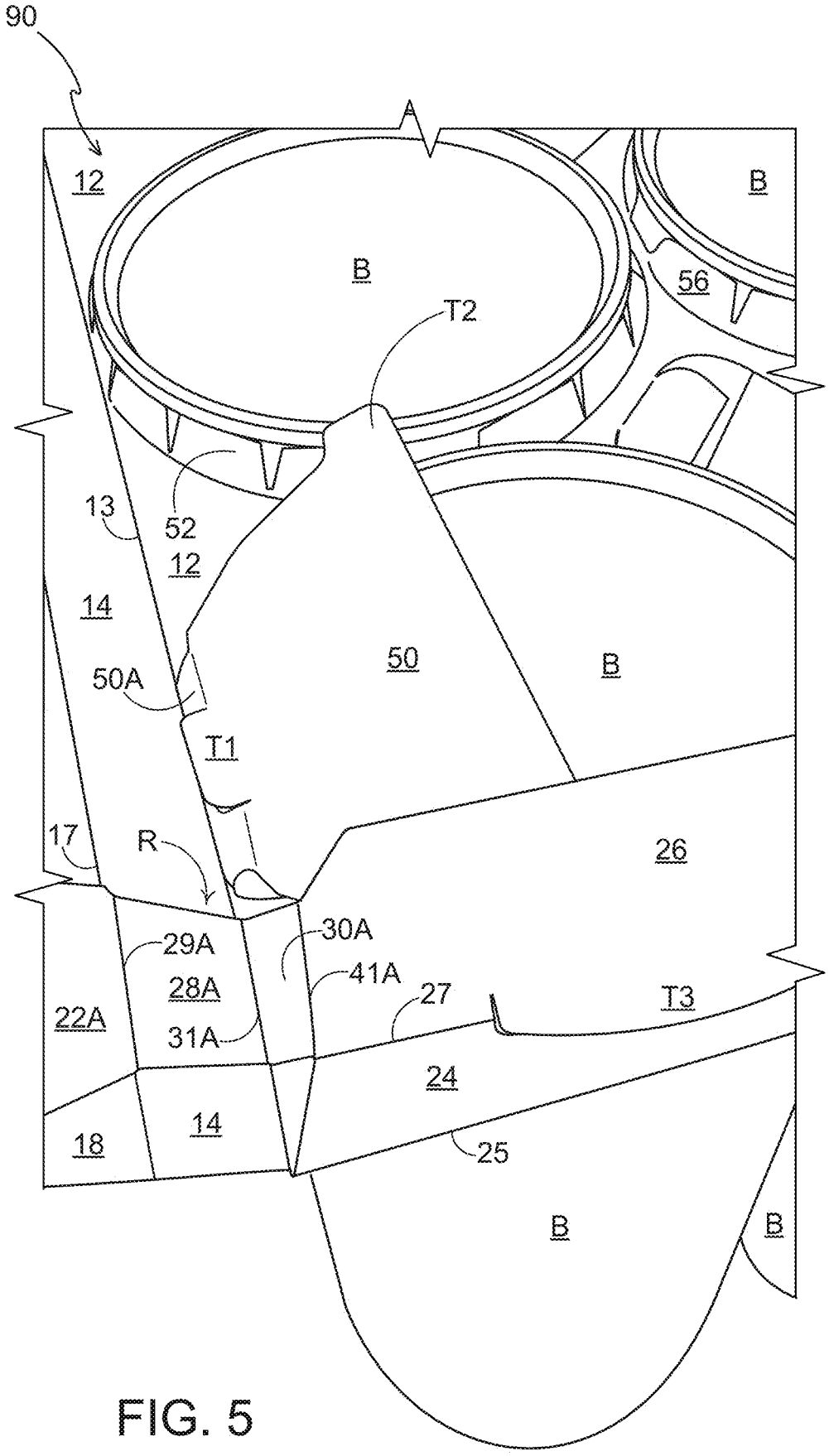
FIGS. 5 to 8 illustrate stages of construction of a package from the blank of FIG. 1.

The blank 10 may be partially folded about fold lines 13, 15 to bring the first and second side panels 14, 16 into non-coplanar relationship with the main panel 12, as shown in FIG. 5.

The blank 10 is folded about fold lines 23A, 23B, 33A, 33B to fold the first, second, third and fourth anchor flaps 22A, 22B, 32A, 32B into substantially face to face relationship with the first or second side panels 14, 16 to which they are hinged.

Figure 8:
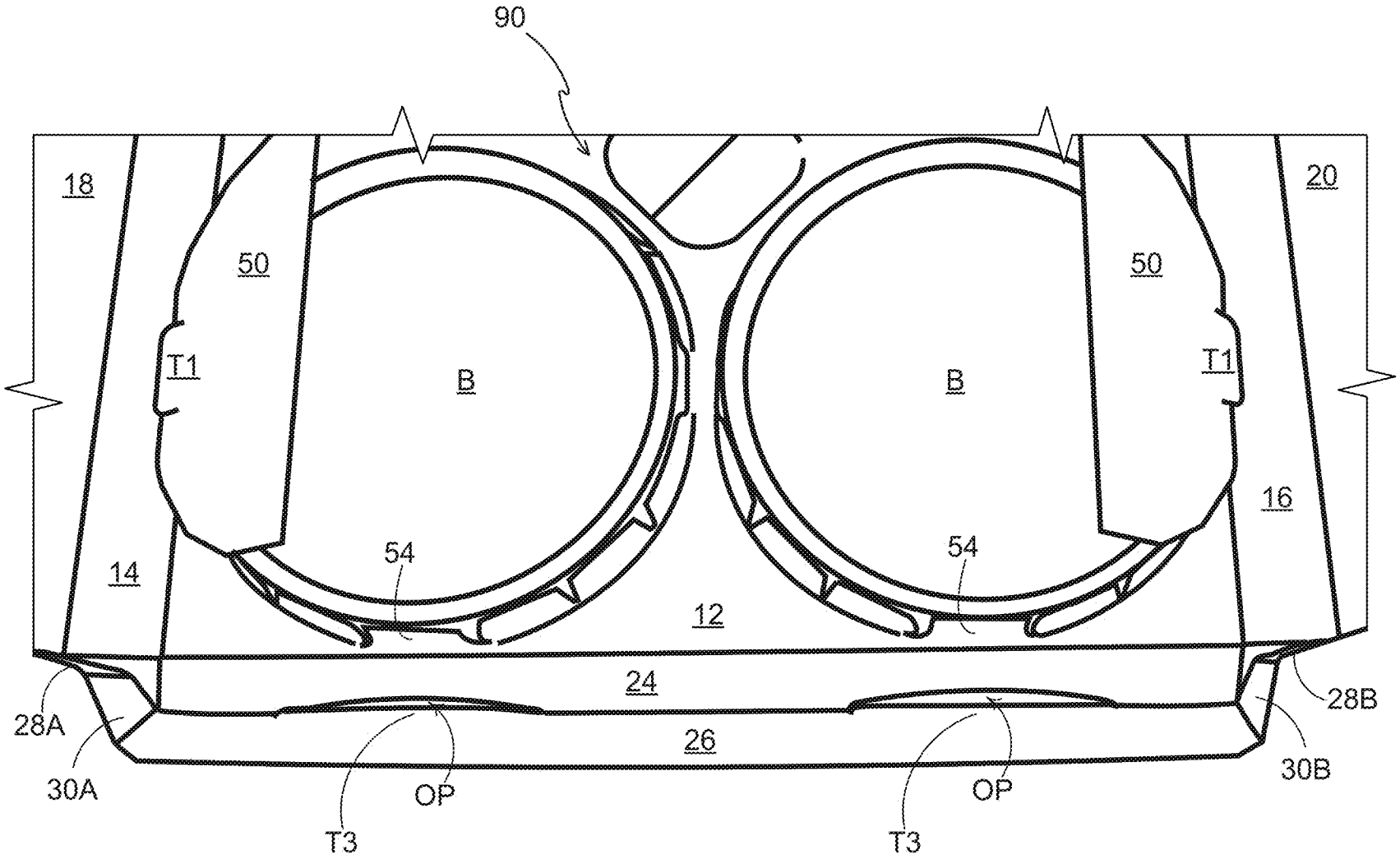

The blank 10 is folded about fold lines 25, 35 to fold the first and second end panels 24, 34 into substantially at least perpendicular relationship with the main panel 12, as illustrated in FIG. 8. In some embodiments the first and second end panels 24, 34 may be folded through an angle greater than 90° so as to be inclined, as illustrated in FIG. 4B.

The blank 10 is folded about fold lines 27, 37 to fold the first and second top end flaps 26, 36 with respect to the respective one of the first and second end panels 24, 34 to which they are hinged.

The first and second top end flaps 26, 36 may be folded over an upper end of an article B or articles B disposed adjacent to the first and second ends of the main panel 12.

The first and second top end flaps 26, 36 may be folded to be substantially parallel to the main panel 12.

The first and second end panels 24, 34 and first and second top end flaps 26, 36 may be folded automatically in response to folding the first, second, third and fourth anchor flaps 22A, 22B, 32A, 32B into substantially face contacting relationship with the respective one of the first and second side panels 14, 16.

A portion of an article B, a flange, chime or rim F, is received in an article engaging opening OP in the first and second end panels 24, 34, as shown in FIG. 4B.

The blank 10 is folded about fold lines 13, 15 to bring the first and second side panels 14, 16 into substantially perpendicular relationship with the main panel 12.

Figure 6:
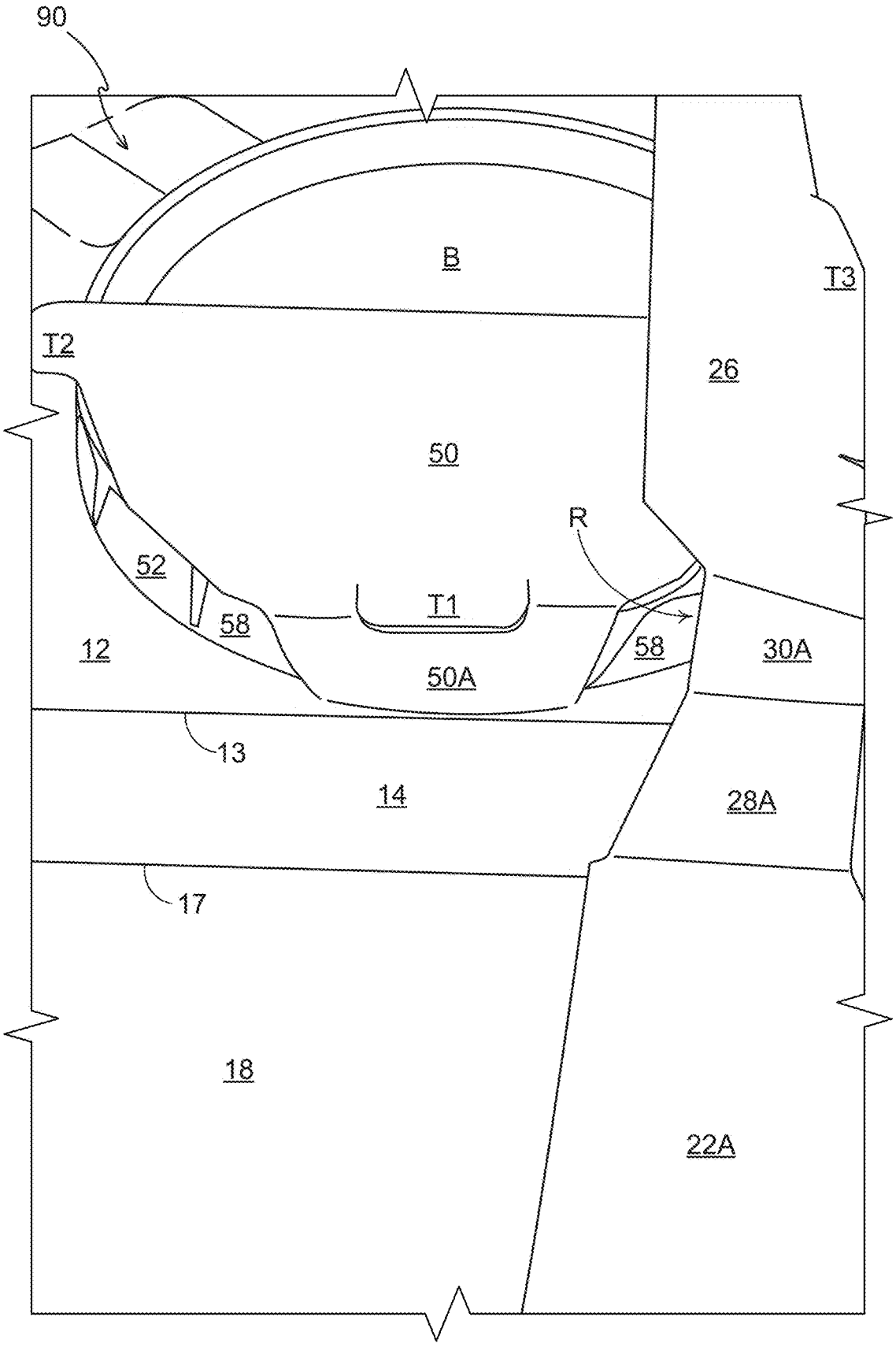

The recesses R are arranged to avoid collision between the connecting panels 28A, 38A, 28B, 30B, 38A, 40A, 38B, 40B and the friction flaps 50 and/or third teeth 50A, best illustrated in FIGS. 5 and 6, when the first and second side panels 14, 16 are folded about an upper portion of the article group.

The connecting panels 28A, 38A, 28B, 30B, 38A, 40A, 38B, 40B are folded into face-to-face relationship with the connecting panel 28A, 38A, 28B, 30B, 338A, 40A, 38B, 40B to which they are hingedly connected.

The blank 10 is folded about fold line 17 to fold the first top panel 18 over the tops of the articles B. The blank 10 is folded about fold line 19 to fold the second top panel 20 over the tops of the articles B and into overlapping relationship with the first top panel 18 to form a composite top panel 18/20.

The locking tabs 60, 62 are displaced out of the plane of the second top panel 20, downwardly so as to pass through a respective one of the receiver openings. The receiver tabs 64, 66 are displaced out of the plane of the first top panel 18 as a consequence.

The locking tabs 60, 62 and the first and second receiver tabs 64, 66 may engage with the perimeter of a respective handle opening. Shoulders of the locking tabs 60, 62 may engage with an edge of each of the opening defined by the first and second receiver tabs 64, 66 in the first top panel 318.

At least one of the handle tabs 70, 72 may engage with locking tab 60, 62 and/or a receiver tab 64, 66 to secure said tab 60, 62, 64, 66 in the handle opening.

The locking tabs 60, 62 and/or the receiver tabs 64, 66 may also serve to function as a spacer between the composite top panel 18/20 and the main panel 12. The locking tabs 60, 62 may engage the main panel 12 along the perimeters of the handle openings and/or the lower surface of the main panel 12 and may thereby serve as tension members for maintaining a spacing between the main panel 12 and the composite top panel 18/20 so as to prevent the spacing from increasing. Additionally, the receiver tabs 64, 66 and/or the locking tabs 60, 62 may engage or abut with the inside or upper surface of the main panel 12 and may thereby brace between the composite top panel 18/20 and the main panel 12 to maintain a spacing therebetween so as to assist in preventing the spacing from decreasing. Thus, at least a portion of the locking tab 60, 62 and/or at least a portion of one or more of the receiver tabs 64, 66 may be disposed between the first top panel 18 and the main panel 12 to maintain a spacing therebetween.

The locking tabs 60, 62 may also provide a cushioning tab improving comfort when the package 90 is carried by inserting one or more fingers into the openings in the composite top panel 18/20 and the main panel 12.

The first and second receiver tabs 64, 66 when folded may extend through the handle openings.

The locking tabs 60, 62 may also engage with the main panel 12, passing through a respective one of the handle openings. Shoulders of the locking tabs 60, 62 may engage with an underside of the main panel; the underside being a second side of the main panel 12 opposing a first side through which the locking tab 60, 62 was received.

The receiver tabs 64, 66 and/or one or both of the handle tabs 70, 72 may provide a biasing mechanism; said tabs 64, 66, 70, 72 having a natural or inherent tendency to return to the unfolded condition. This may provide, or supplement, the resilient bias of the locking tabs 60, 62 to return to an unfolded condition.

The first and second top panels 18, 20, along with the first and second top end flaps 26, 36 may apply force or pressure onto the friction flaps 50, the peripheral tabs T1, T2. Force or pressure may also be applied to the cover tab T3 by first and second top panels 18, 20. The force is transferred to the article B and increases the friction between the carrier 90 and the article B. In this way, the articles B may be maintained in specific or desired orientation with respect to the article carrier 90. The increased grip of the article carrier 90 upon the article B prevents or inhibits movement of the article B out of said desired orientation.

The article engaging structures in the end panels 24, 34 may also contribute to improving the security of the articles B, further increasing friction between the carrier 90 and the article B.

Figure 9B:
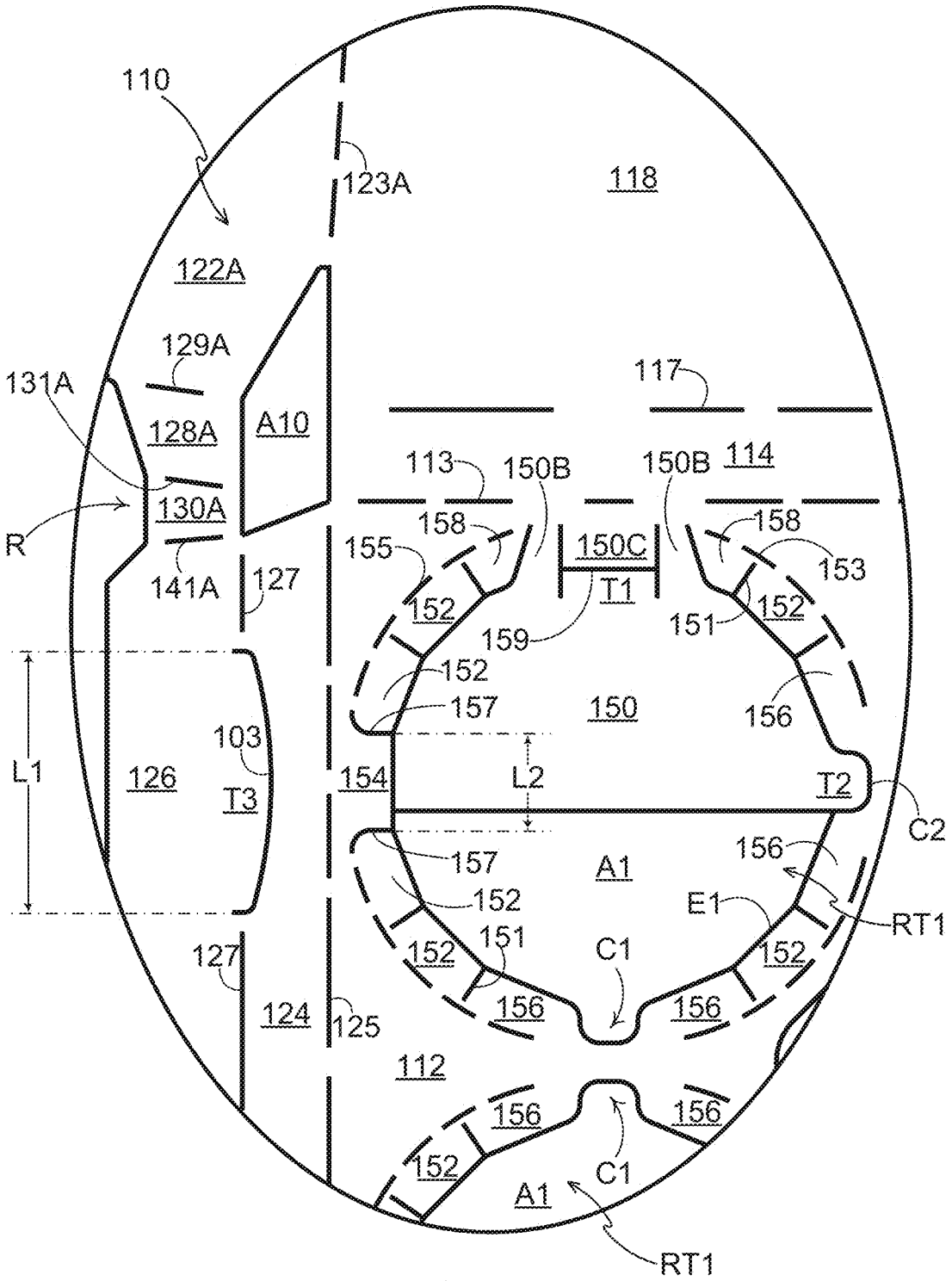
FIG. 9B is an enlarged plan view of a portion of the blank of FIG. 9.

Referring now to FIGS. 9, 9B, and 10 there is shown an alternative embodiment of the present disclosure. In the second illustrated embodiment, like numerals have, where possible, been used to denote like parts, albeit with the addition of the prefix "100" to indicate that these features belong to the second embodiment. The alternative embodiment shares many common features with the embodiment of FIGS. 1 to 8, therefore only the differences from the embodiment illustrated in FIGS. 1 to 8 will be described in any greater detail.

FIG. 9 shows a blank 110 comprising a plurality of panels 112, 114, 116, 118, 120, including a main panel 112 for forming a lower wall or engaging panel of a carrier 190 (see FIG. 10).

A first side panel 114 is hingedly connected to a first side of the main panel 112 by a hinged connection in the form of a fold line 113. A first top or cover panel 118 is hingedly connected to the first side panel 114 by a hinged connection in the form of a fold line 117.

A second side panel 116 is hingedly connected to a second side of the main panel 112 by a hinged connection in the form of a fold line 115. A second top or cover panel 120 is hingedly connected to the second side panel 116 by a hinged connection in the form of a fold line 119.

The blank 110 is substantially similar to the blank 10 of FIG. 1, albeit the endmost article retention structures RT1 comprise a modified friction flap 150. The friction flap 150 is coupled to the main panel 112 by a pair of connecting tabs 150B. The pair of connecting tabs 150B are spaced apart from each other by an article engaging tab 150C. The article engaging tab 150C is defined at least in part by a cut line 159. The cutline 159 is substantially "H" shaped and defines in part the first peripheral tab T1. The first peripheral tab T1 is separated from the article engaging tab 150C by the cutline 159. Side edges of each of the first peripheral tab T1 and the article engaging tab 150C are defined by the cutline 159.

The article engaging tab 150C engages the article B below a flange or chime of the article B in a similar manner to the plurality of teeth or tabs 152, 154, 156, 158 of the article retention structures RT1, RT2, as shown in FIG. 10.

Figure 13:
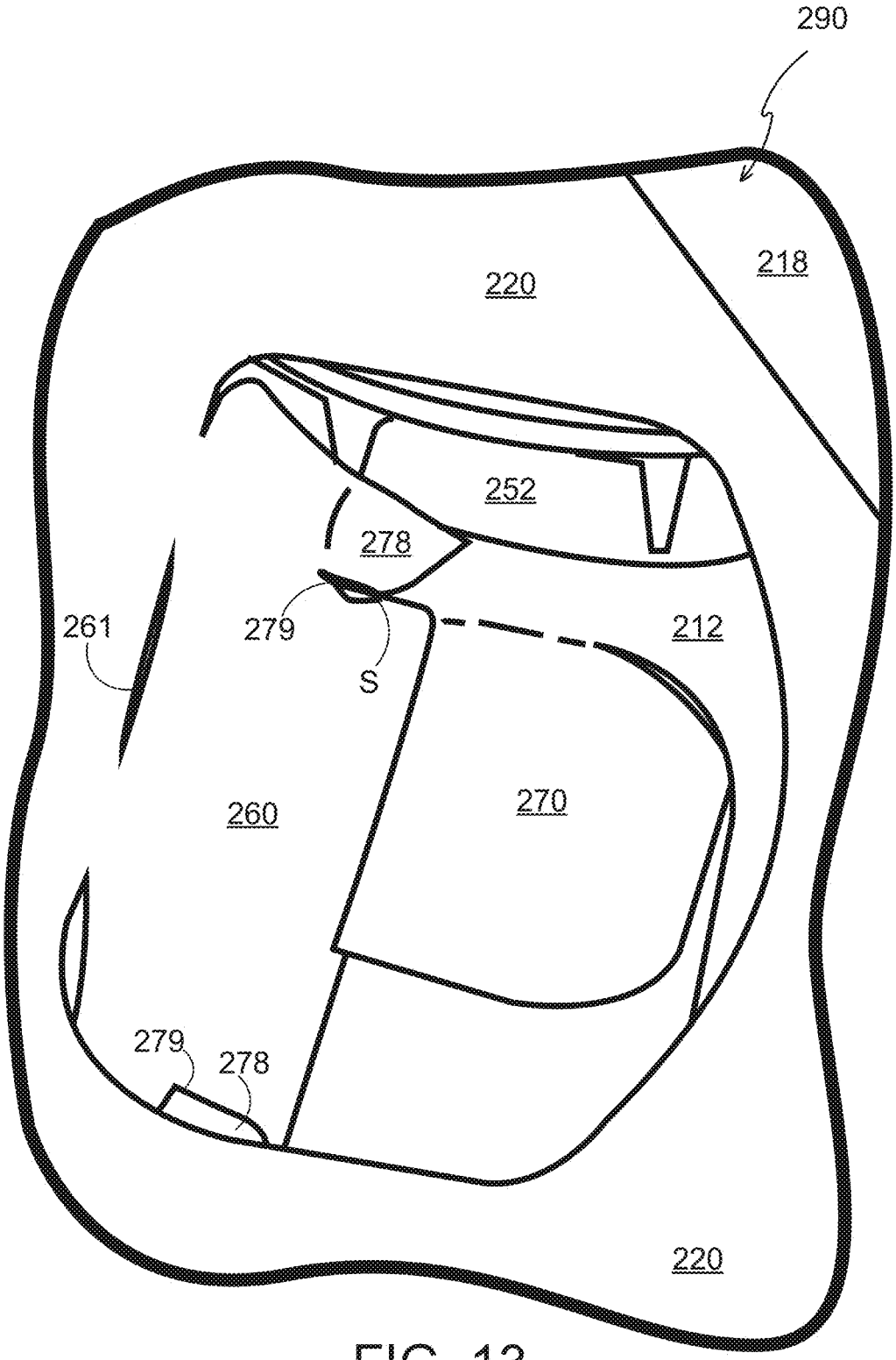

Referring now to FIGS. 11 to 13 there is shown a further alternative embodiment of the present disclosure. In the third illustrated embodiment, like numerals have, where possible, been used to denote like parts, albeit with the addition of the prefix "200" to indicate that these features belong to the third embodiment. The alternative embodiment shares many common features with the embodiments of FIGS. 1 to 10, therefore only the differences from the embodiments illustrated in FIGS. 1 to 10 will be described in any greater detail.

FIG. 11 shows a blank 210 comprising a plurality of panels 212, 214, 216, 218, 220, including a main panel 212 for forming a lower wall or engaging panel of a carrier 290 (see FIGS. 12 and 13).

A first top panel 218 and second top panel 220 are arranged to be disposed in at least partially overlapping relationship with each other. The overlapping portions of the first and second top panels 218, 220 are provided with a locking structure for locking the first and second top panels 218, 220. The locking structure cooperates with handle openings in the main panel 212 to secure the first and second top panels 218, 220 to the main panel 212.

The blank 210 comprises two handle openings. Each handle opening is defined in, or struck from, a region of the main panel 212 disposed centrally between four apertures A1, A2 arranged as two adjacent pairs of apertures A1, A2. Each handle opening may be defined, at least in part, by one or more handle flaps 270, 272. In the illustrated embodiment, the handle openings are defined by a pair of handle flaps 270, 272. The pair of handle flaps 270, 272 includes a first, major, handle flap 270 and a second, minor, handle flap 272, the minor handle flap 272 being smaller than the major handle flap 270. The first handle flap 270 is hingedly connected to the main panel 212 by a first fold line 271 and the second handle flap 272 is hingedly connected to the main panel 212 by a second fold line 273. The handle opening may be substantially square or diamond shaped. The second fold line 273 may be disposed adjacent to the first fold line 271, and may be separated therefrom by an arcuate cut line, defining a rounded corner of the handle opening.

The locking structure comprises at least one receiver LR1, LR2 in the form of an opening in the first top panel 218. The first top panel 218 comprises a plurality of openings, more specifically two openings, although in other embodiments one or more openings may be provided. Each of the openings is arranged to be in vertical registry or alignment with a handle opening provided in the main panel 212. Each opening is defined by a tab 264, 266 (also referred to herein as receiver tabs). In the illustrated embodiment, each opening is defined by a single tab 264, 266.

A first receiver tab 264 is hinged to the first top panel 218 by a first hinged connection in the form of a first fold line 265 and forms part of a first receiver LR1. A second receiver tab 266 is hinged to the first top panel 218 by a second hinged connection in the form of a second fold line 267 and forms part of a second receiver LR2. The fold lines 265, 267 are obliquely oriented with respect to the tubular axis of the tubular structure formed at least by the first top panel 218, the second top panel 220, the first and second side panels 214, 216 and the main panel 212. The second receiver tab fold line 267 is divergently arranged with respect to the first receiver tab fold line 265. The second receiver tab fold line 267 and the first receiver tab fold line 265 are arranged to diverge towards the fold line 217 hinging the first top panel 218 to the first side panel 214. The fold lines 265, 267 are obliquely oriented with respect to the fold line 217 hinging the first top panel 218 to the first side panel 214. In FIG. 11, the free side edge $SE_1$ of the first top panel 218 and the fold line 217 each is parallel to, and extends along, the tubular axis. The second receiver tab fold line 267 may be arranged orthogonally to the first receiver tab fold line 265.

Each of the first and second receiver tabs 264, 266 comprises a pair of cut 277. Cuts 277 extend inwardly from opposing side edges of the respective one of the first and second receiver tabs 264, 266. The cuts 277 define, at least in part, a proximal portion of the tab 264, 266 adjacent the respective hinged connection 265, 267 to the first top panel 218. The cuts 277 define, at least in part, a second portion of the tab 264, 266 distal from the respective hinged connection 265, 267 to the first top panel 218. The cuts 277 may be non-linear and may be generally "V" or "J" shaped. The second or distal portion of the tab 264, 266 may be generally 'arrowhead' shaped so as to define a pair of opposing shoulders or detents for securely engaging the handle opening.

The cuts 277 define, at least in part, foldable, or yieldable, wing portions of the first and second receiver tabs 264, 266. The wing portions are arranged to rest or engage with an upper surface of the main panel 212 whilst the shoulders or detents of the distal portion of the first and second receiver tabs 264, 266 are disposed below, optionally engaging, an opposing lower surface of the main panel 212.

The locking structure comprises at least one locking element L1, L2 for being received in the receiver LR1, LR2. The locking element L1, L2 comprises a tab 260, 262 struck from the second top panel 220, the illustrated embodiment comprises two tabs 260, 262 each arranged to be engageable with one of the receiver openings and a respective one of the handle openings. Each tab 260, 262 is hinged to the second top panel 220 by a respective hinged connection 261, 263.

Each of the locking elements L1, L2 is arranged to be in vertical registry or alignment with a handle opening provided in the main panel 212 and with one of the receiver openings provided in the first top panel 218. The locking elements L1, L2 are defined by one of the two tabs 260, 262 (also referred to herein as locking tabs). In the illustrated embodiment, each locking element L1, L2 is defined by a single locking tab 260, 262.

A first locking tab 260 is hinged to the second top panel 220 by a first hinged connection in the form of a first fold line 261 and forms part of a first locking element L1. A second locking tab 262 is hinged to the second top panel 220 by a second hinged connection in the form of a second fold line 263 and forms part of a second locking element L2. The fold lines 261, 263 are obliquely oriented with respect to the tubular axis of the tubular structure formed at least by the first top panel 218, the second top panel 220, the first and second side panels 214, 216 and the main panel 212. The second locking tab fold line 263 is divergently arranged with respect to the first locking tab fold line 261. The second locking tab fold line 263 and the first locking tab fold line 261 are arranged to diverge towards the free side edge $SE_2$ of the second top panel 220. The fold lines 261, 263 are obliquely oriented with respect to the fold line 219 hinging the second top panel 220 to the second side panel 216. In FIG. 11, the free side edge $SE_2$ of the second top panel 220 and the fold line 219 each is parallel to, and extends along, the tubular axis. The second locking tab fold line 263 may be arranged orthogonally to the first locking tab fold line 261.

Each of the first and second locking tabs 260, 262 comprises a pair of cuts 279. Cuts 279 extend inwardly from opposing side edges of the respective one of the first and second receiver tabs 260, 262. The cuts 279 define, at least in part, a proximal portion of the tab 260, 262 adjacent the respective hinged connection 261, 263 to the second top panel 220. The cuts 279 define, at least in part, a second portion of the tab 260, 262 distal from the respective hinged connection 261, 263 to the second top panel 220. The cuts 279 may be non-linear and may be generally "V" or "J" shaped. The second or distal portion of the tab 260, 262 may be generally 'arrowhead' shaped so as to define a pair of opposing shoulders or detents S (see FIG. 13) for securely engaging the handle opening and/or receiver LR1, LR2.

The cuts 279 define, at least in part, foldable, or yieldable, wing portions 278 (see FIGS. 12 and 13) of the first and second locking tabs 260, 262. The wing portions 278 are arranged to rest or engage with an upper surface of the main panel 212 whilst the shoulders or detents S of the distal portion of the first and second locking tabs 260, 262 are disposed below, optionally engaging, an opposing lower surface of the main panel 212.

The major handle flap 270 may be arranged to prevent the first and second locking tabs 260, 262 from unfolding and/or disengaging from the main panel 212. A side edge of the major handle flap 270 may inhibit movement of the respective first and second locking tab 260, 262; a respective one of the first and second receiver tabs 264, 266 being disposed below or behind the said locking tab 260, 262 is also prevented, or inhibited, from unfolding and/or disengaging from the main panel 212. The minor handle flap 272 of each handle opening is disposed below or behind one of the first and second receiver tabs 264, 266 and may increase the resilient bias of the locking tabs 260, 262 and the receiver tabs 264, 266 towards the major handle flap 270 and/or may bias the shoulders or detents S of the locking tabs 260, 262 and the shoulders or detents of the receiver tabs 264, 266 towards the underside of the main panel 212.

In the embodiment illustrated in FIG. 11, article engaging structures have been omitted, by removing the non-linear cutlines.

Referring now to FIGS. 14 to 18 there is shown further alternative embodiments of the present disclosure. In the fourth and fifth illustrated embodiments, like numerals have, where possible, been used to denote like parts, albeit with the addition of the prefix "300"; "400" to indicate that these features belong to the fourth and fifth embodiments respectively. The alternative embodiments share many common features with the embodiments of FIGS. 1 to 13, therefore only the differences from the embodiments illustrated in FIGS. 1 to 13 will be described in any greater detail.

Figure 14:
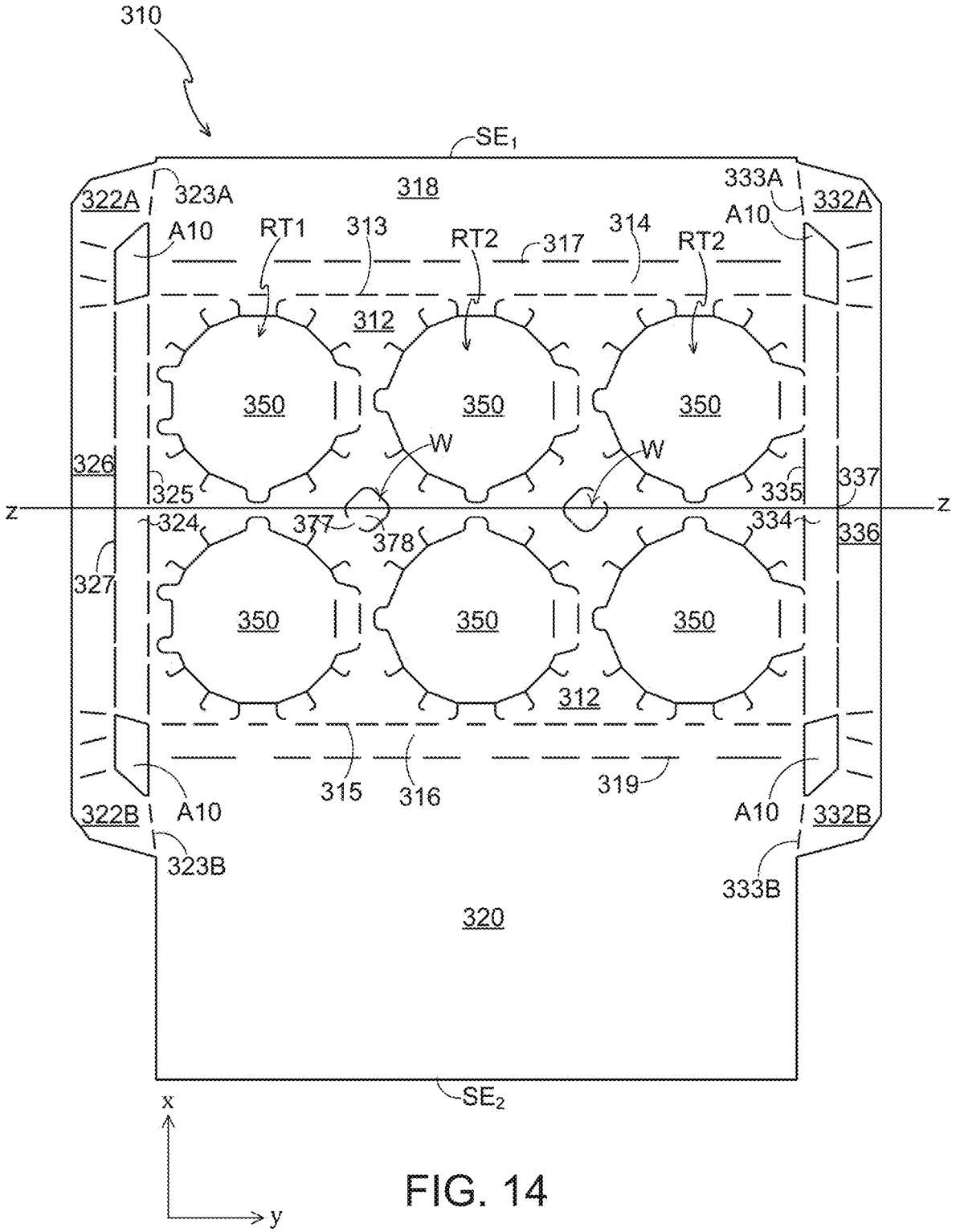
FIG. 14 is a plan view from above of a blank for forming a carrier according to a fourth embodiment.

FIG. 14 shows a blank 310 comprising a plurality of panels 312, 314, 316, 318, 320, including a main panel 312 for forming a lower wall or engaging panel of a carrier (not shown).

A first side panel 314 is hingedly connected to a first side of the main panel 312 by a hinged connection in the form of a fold line 313. A first top or cover panel 318 is hingedly connected to the first side panel 314 by a hinged connection in the form of a fold line 317.

A second side panel 316 is hingedly connected to a second side of the main panel 312 by a hinged connection in the form of a fold line 315. A second top or cover panel 320 is hingedly connected to the second side panel 316 by a hinged connection in the form of a fold line 319.

The first top panel 318, the first side panel 314, the main panel 312, the second side panel 316 and the second top panel 320 together form a tubular structure which defines a tubular axis z-z.

The first top panel 318, second top panel 320, first and second side panels 314, 316 and main panel 312 form a tubular structure. Each end of the tubular structure is closed by an end closure structure. The end closure are substantially similar to those of the previous embodiments and comprise, end panels 24, 334, top end flaps 326, 336, anchor flaps 322A, 322B, 332A, 332B and pairs of hinged panels, a pair of hinged panels connecting each anchor flap 322A, 322B, 332A, 332B to one of the top end flaps 326, 336.

Figure 15:
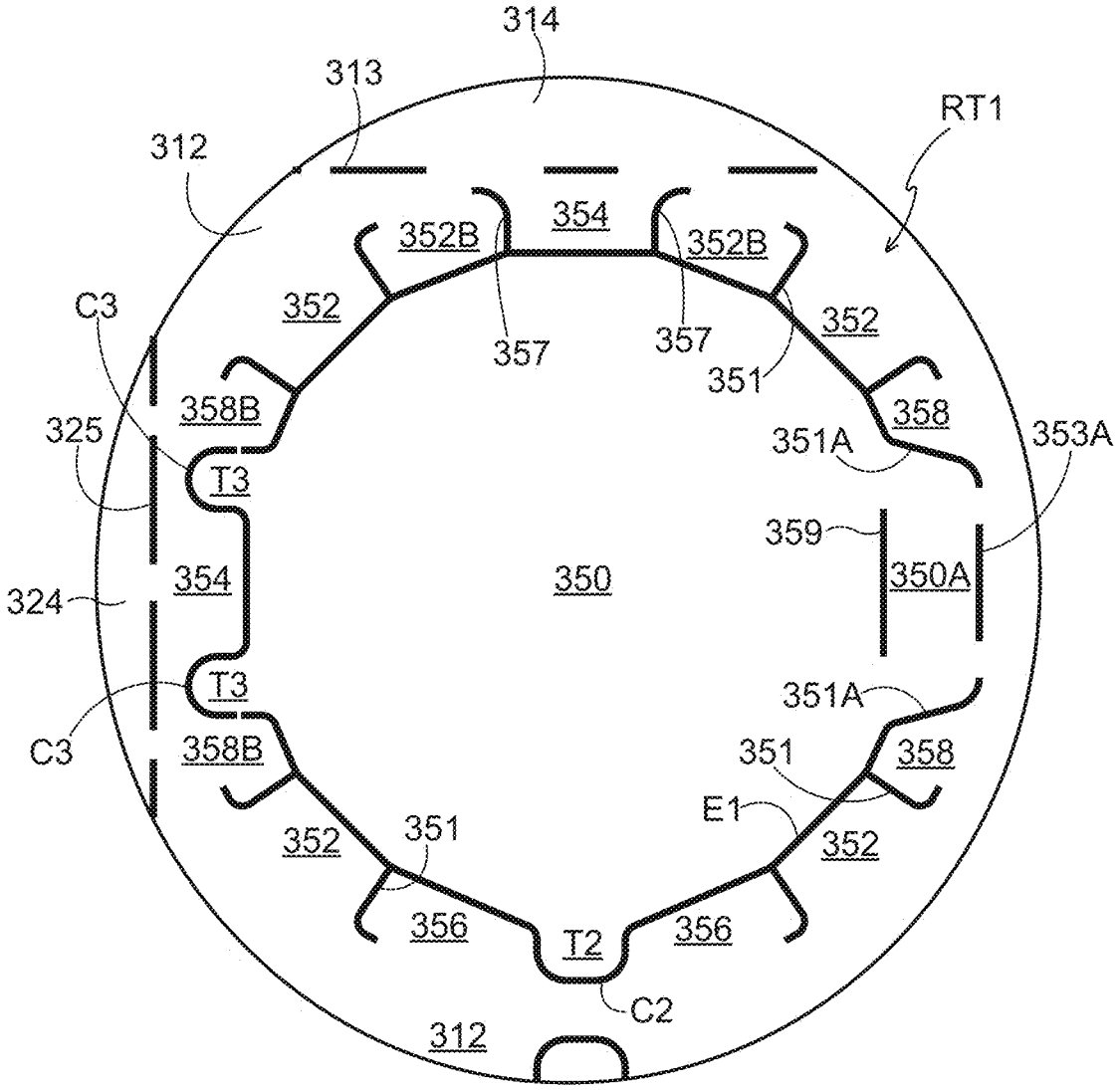
FIG. 15 is an enlarged plan view of a portion of the blank of FIG. 14.
Figure 16:
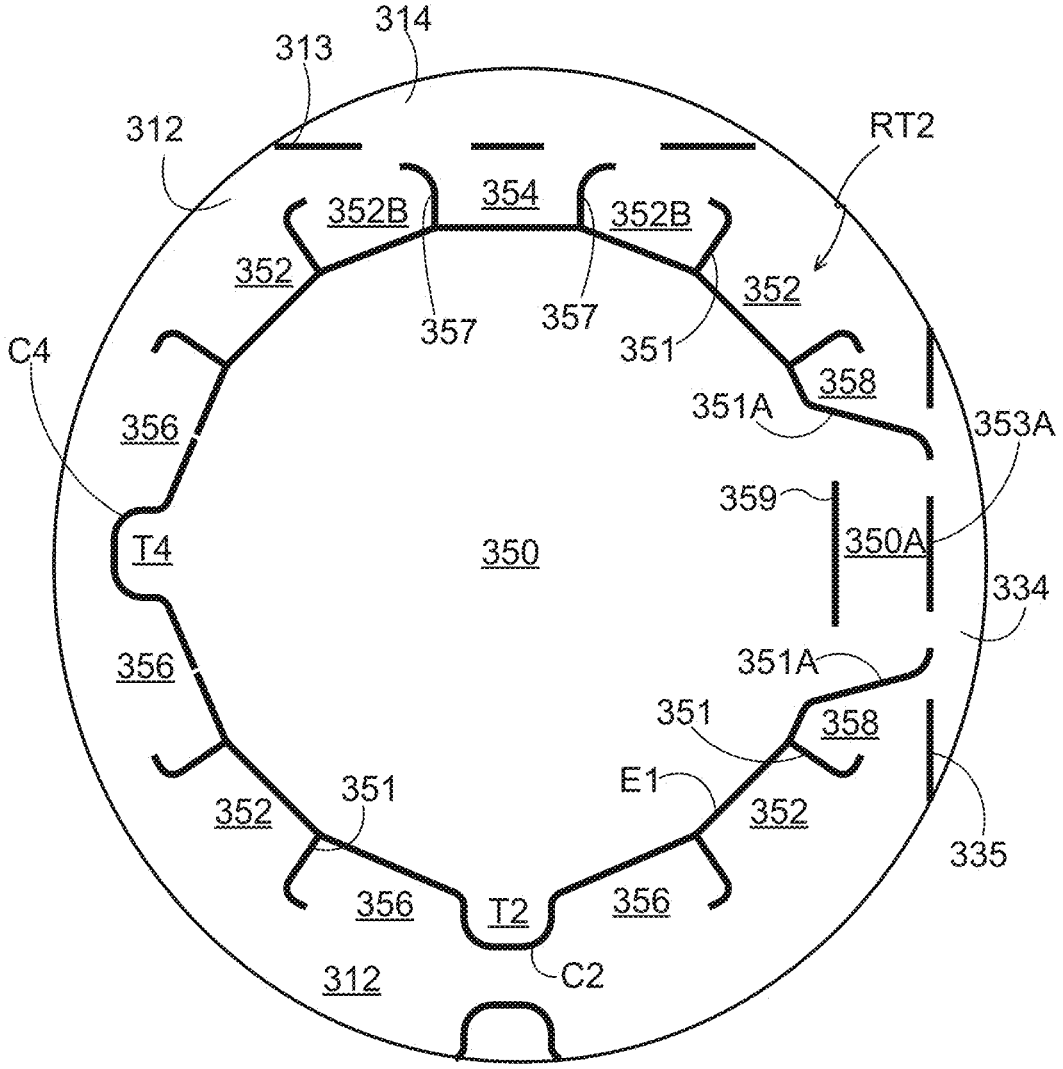
FIG. 16 is an enlarged plan view of another portion of the blank of FIG. 14.

In the embodiment of FIGS. 14 to 16 the first top or cover panel 318 is configured to be adhesively secured to the second top or cover panel 320. The locking structure, locking element and receiver, of the previous embodiments has been omitted or removed. The first top or cover panel 318 is configured to be smaller than the second top or cover panel 320, that is to say the width of the first top or cover panel 318 in a direction transverse to a tubular axis of the tubular structure is less than the width of the second top or cover panel 320 in said transverse direction. The region of overlap between the first top or cover panel 318 and the second top or cover panel 320 is thus offset with respect to a notional medial line bisecting the main panel 312 in a longitudinal direction.

The main panel 312 of the blank 310 includes at least one article retention structure RT1, RT2. The main panel 312 comprises a plurality of article retention structures RT1, RT2, specifically six article retention structures RT1, RT2 arranged in 2×3 matrix or array. Each of the article retention structures RT1, RT2 comprises an opening.

The article retention structures RT1, RT2 of the embodiment of FIG. 14 take the form of a plurality of teeth or tabs 352, 352B, 354, 354B, 356, 358, 358B arranged in an annular series and form part of an article receiving opening, best shown in FIGS. 15 and 16.

The plurality of teeth 352, 352B, 354, 354B, 356, 358, 358B are provided by the main panel 312. Each of the teeth 352, 352B, 354, 354B, 356, 358, 358B comprises a hinged connection. The hinged connection may be defined between a pair of cutaways, each of the pair of cutaways make take the form of one of; a cutline, slit, notch or recess. When a cutline is employed, the cutline may be substantially "J" or "L" shaped.

Each of the plurality of teeth 352, 352B, 354, 354B, 356, 358, 358B comprises an engaging edge E1 opposing a hinged edge. The engaging edges E1 are defined by a linear portion of a cut line defining a friction flap 350, the first aperture A1 and second aperture A2 of the previous embodiments have been omitted or removed. Each engaging edge E1 may define a part of a polygon. The illustrated embodiment comprises thirteen teeth 352, 352B, 354, 354B, 356, 358, 358B together defining a part of a polygon. Each tooth 352, 352B, 354, 354B, 356, 358, 358B comprises a pair of side edges. Each side edge is defined by a cut 351, 357 or by a recess, the recess defining a tab T2, T3, T4 extending radially outward from, and integral with, the friction tab 350.

The blank 310 comprises two first article retention structures RT1 and four second article retention structures RT2.

The first article retention structures RT1 are disposed adjacent to a first end of the main panel 312 defined by the hinged connection to first end panel 324. The first end of the main panel 312 may be a trailing or upstream end when being conveyed through a packaging machine (not shown).

A first pair of second article retention structures RT2 are disposed adjacent to a second end of the main panel 312 defined by the hinged connection to second end panel 334. The second end of the main panel 312 may be a leading or downstream end when being conveyed through a packaging machine (not shown).

A second pair of second article retention structures RT2 are disposed between the first article retention structures RT1 and the first pair of second article retention structures RT2.

The first article retention structures RT1 comprise an article receiving opening defined in part by a cover or friction flap 350.

The first article retention structures RT1 comprise a plurality of teeth or tabs 352, 352B, 354, 354B, 356, 358, 358B, best shown in FIG. 15. The plurality of teeth or tabs 352, 352B, 354, 354B, 356, 358, 358B are arranged as an annular series disposed about the friction flap 350.

The first article retention structures RT1 comprise a plurality of first teeth or engaging tabs 352 for supporting or suspending an article B.

The first article retention structures RT1 comprise a second tooth or engaging tab 354 which is disposed proximate the hinged connection between the engaging panel 312 and the first end panel 324. The second tooth 354 is defined in part by a pair of third peripheral tabs T3 extending from the friction flap 350. When the friction flap 350 is displaced out of the plane of the main panel 312, third notches or recesses C3 are defined on opposed sides of the second tooth 354.

The first article retention structures RT1 comprise a third tooth or tab 350A, also referred herein as connecting tab 350A which is disposed opposite the second tooth 354. The third tab 350A is coupled to, or integral with the friction flap 350. The third tooth or tab 350A may be defined in part by cut lines 351A. The cut lines 351A may be obliquely oriented with respect to a fold line in the form of a cut line 353A hinging the third tab 350A to the main panel 312 or to the end panel 334. The cut lines 351A may be arranged to be divergently oriented with respect to each other as they approach the friction flap 350. In this way a portion of the third tab 350A proximate the friction flap 350 is wider than a portion of the third tab 350A proximate the main panel 312. The third tab 350A may be defined, at least in part, by a fold line in the form of a cut line 359 separating a portion of the third tab 350A from the friction flap 350. The fold line 359 may be linear. The fold lines 359 and 353A of at least one of the connecting tabs 350A are generally perpendicular to the tubular axis z-z of the article carrier. FIG. 14 shows an embodiment in which the fold lines 359 and 353A of all of the connecting tabs 350A are generally perpendicular to the tubular axis z-z while FIG. 17 shows another embodiment wherein the fold lines 459 and 453A of at least one of the connecting tabs 450A are generally perpendicular to the tubular axis z-z.

The third tooth or tab 350A may be flanked by a partial tooth or tab 358 on each side thereof.

The friction flap 350 comprises a second peripheral tab T2 extending therefrom. The second peripheral tab T2 defines a second recess C2.

The second recess C2 interrupts the plurality of teeth 352, 352B, 354, 354B, 356, 358, 358B of the first article retention structures RT1. The second recess C2 is provided at a location about the circumference of the article receiving opening disposed in closest proximity to an adjacent first article retention structure RT1. The second recess C2 extends from the article receiving opening towards the adjacent first article retention structures RT1.

The second recess C2 may be flanked by a fourth tooth or tab 356 on each side thereof. Each fourth tooth or tab 356 may occupy a greater circumferential distance than one of the first teeth 352. Each fourth tooth 356 may be defined in part by a cutline 351 and by the second recess C2. The cutline terminates in a 'J' or 'C' shaped cut. The 'J' shaped cut may be arranged to curve toward the second recess C2.

The first article retention structures RT1 comprise a fifth tooth or engaging tab 354B which is disposed proximate the hinged connection between the engaging panel 312 and one of the first or second side panels 314, 316. The fifth tooth 354B is defined in part by a pair of cutlines 357 extending outwardly from the friction flap 350.

The fifth tooth 354B may be in sufficiently close proximity to one of the fold lines 313, 315 hinging the first and second side panels 314, 316 to the engaging panel 312 that a respective one of the fold lines 313, 315 effectively serves as a hinged connection to the fifth tooth 354B. The fifth tooth 354B may be defined by cuts 357 which comprise a 'J' or 'C' shaped cut proximate said one of the fold lines 313, 315. The fifth tooth 354B is disposed opposite the second recess C2.

The fifth tooth 354B may be flanked by a sixth tooth or tab 352B on each side thereof. Each sixth tooth 352B is defined, in part, by a pair of cutlines 351, 357 each of which terminates in a 'J' or 'C' shaped cut. The 'J' shaped cuts may be arranged to curve toward each other that is to say converge towards each other as they extend away from the friction flap 350. A terminal ends of the 'J' shaped cut of cut line 351 extends towards the terminal end of the 'J' shaped cut of cut line 357.

A pair of seventh teeth or tabs 358B may be provided on opposed sides of the second tooth 354. Each seventh tooth 358B is defined by a cutline 351 and by one of the third recesses C3. The cutline terminates in a 'J' or 'C' shaped cut. The 'J' shaped cut may be arranged to curve toward the third recess C3.

The second article retention structures RT2 are similar in construction to the first article retention structures RT1, albeit the second tooth 354 and pair of seventh teeth 358B have been replaced with a fourth notch or recess C4, defined by a fourth peripheral tab T4 extending from the friction flap 350, opposite the connecting tab 350A and by a pair of fourth teeth 356. The fourth recess C4 is provided at a location about the circumference of the article receiving opening disposed in closest proximity to an adjacent first article retention structure RT1 or second article retention structures RT2.

In the second article retention structures RT2 disposed proximate to the second end of the main panel 312, defined by the hinged connection to second end panel 334, the hinged connection 353A of the connecting tab 350A may be coincident or co-linear with the hinged connection, with fold line 335.

In a packaging machine, the connecting tabs 350A define a leading edge or portion of the friction flaps 350 as the blank 310 is conveyed thereon. This may prevent or inhibit the friction flap 350 becoming snagged or causing an obstruction to travel of the blank 310 in the packaging machine.

The blank 310 may comprise at least one stabilisation device W. In the illustrated embodiment, the blank 310 comprises two stabilisation devices W. The stabilization device W takes the form of an opening struck from the blank 310, and may be defined by a flap 378 struck from the main panel 312 and hinged thereto by a hinged connection in the form of a fold line 377. A first stabilisation device W is disposed between first group of four article retention structures RT1, RT2 located proximate a first or leading end edge of the blank 310 and may be disposed centrally between said group of article retention structures RT1, RT2. A second stabilisation device W is disposed between a second group of four article retention structures RT1, RT2 located proximate a second or trailing end edge of the blank 310 and may be disposed centrally between said group of article retention structures RT1, RT2. The stabilisation devices W are configured to receive an abutment peg of a packaging machine to prevent or inhibit misalignment of the blank 310 when applied to the articles B.

FIG. 17 shows a blank 410 comprising a plurality of panels 412, 414, 416, 418, 420, including a main panel 412 for forming a lower wall or engaging panel of a carrier (not shown). A first side panel 414 is hingedly connected to a first side of the main panel 412 by a hinged connection in the form of a fold line 413. A first top or cover panel 418 is hingedly connected to the first side panel 414 by a hinged connection in the form of a fold line 417. A second side panel 416 is hingedly connected to a second side of the main panel 412 by a hinged connection in the form of a fold line 415. A second top or cover panel 420 is hingedly connected to the second side panel 416 by a hinged connection in the form of a fold line 419. Blank 410 is substantially similar to the blank 310 of FIG. 14 and only the differences will be described in greater detail.

The main panel 412 of the blank 410 includes at least one article retention structure RT2, RT3. The main panel 412 comprises a plurality of article retention structures RT2, RT3, specifically six article retention structures RT2, RT3 arranged in 2×3 matrix or array. Each of the article retention structures RT2, RT3 comprises an opening.

Figure 17B:
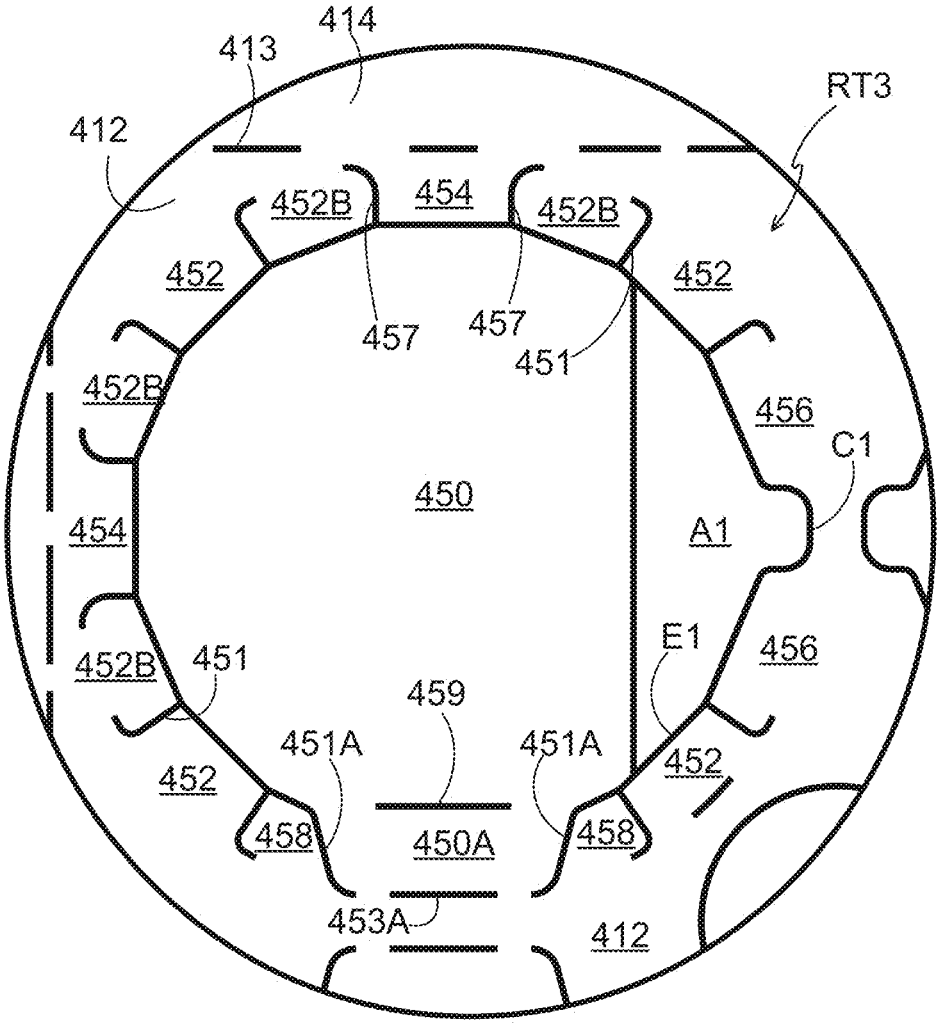
FIG. 17B is an enlarged plan view of a portion of the blank of FIG. 17.

The article retention structures RT2, RT3 of the embodiment of FIG. 17 take the form of a plurality of teeth or tabs 452, 452B, 454, 456, 458 arranged in an annular series and form part of an article receiving opening, best shown in FIG. 17B.

The blank 410 comprises four first article retention structures RT3 and two second article retention structures RT2.

A first pair of first article retention structures RT3 are disposed adjacent to a first end of the main panel 412 defined by the hinged connection to first end panel 424. The first end of the main panel 412 may be a trailing or upstream end when being conveyed through a packaging machine (not shown).

A second pair of first article retention structures RT3 are disposed adjacent to a second end of the main panel 412 defined by the hinged connection to second end panel 434. The second end of the main panel 412 may be a leading or downstream end when being conveyed through a packaging machine (not shown).

A pair of second article retention structures RT2 are disposed between the first pair of first article retention structures RT3 and the second pair of first article retention structures RT3. The pair of second article retention structures RT2 are mirror images or reflections of the first pair of first article retention structures RT3 about a notional line transversely bisecting the main panel 412.

The second article retention structures RT2 are substantially similar to the second article retention structures RT2 of the embodiment of FIG. 16 and as described above and will not be described in further detail.

The first article retention structures RT3 comprise an article receiving opening defined in part by a cover or friction flap 450 and in part by a first aperture A1.

The first article retention structures RT3 comprise a plurality of teeth or tabs 452, 452B, 454, 456, 458, best shown in FIG. 17*b*. The plurality of teeth or tabs 452, 452B, 454, 456, 458 are arranged as an annular series disposed about the friction flap 450 and first aperture A1.

The first article retention structures RT3 comprise a plurality of first teeth or engaging tabs 452 for supporting or suspending an article B.

The first article retention structures RT3 comprise a pair of second teeth or engaging tabs 454. The first article retention structures RT3 comprise a first second tooth or engaging tab 454 which is disposed proximate the hinged connection between the engaging panel 412 and a respective one of the first and second end panels 424, 434. The first second tooth 454 may be in sufficiently close proximity to one of the fold lines 425, 435 hinging the first and second end panels 424, 434 to the engaging panel 412 that a respective one of the fold lines 425, 435 effectively serves as a hinged connection to the first second tooth 454. The first second tooth 454 may be defined by cuts 457 which comprise a 'J' or 'C' shaped cut proximate said one of the fold lines 425, 435.

The first article retention structures RT3 comprise a second second tooth or engaging tab 454 which is disposed proximate the hinged connection between the engaging panel 412 and a respective one of the first and second side panels 414, 416. The second second tooth 454 may be in sufficiently close proximity to one of the fold lines 413, 415 hinging the first and second end panels 414, 416 to the engaging panel 412 that a respective one of the fold lines 413, 415 effectively serves as a hinged connection to the second second tooth 454. The second second tooth 454 may be defined by cuts 457 which comprise a 'J' or 'C' shaped cut proximate said one of the fold lines 413, 415.

The first article retention structures RT3 comprise a third tooth or tab 450A, also referred herein as connecting tab 450A which is disposed opposite the second second tooth 454. The third tab 450A is coupled to, or integral with the friction flap 450. The third tooth or tab 450A may be defined in part by cut lines 451A. The cut lines 451A may be obliquely oriented with respect to a fold line 453A hinging the third tab 450A to the main panel 412. The cut lines 451A may be arranged to be divergently oriented with respect to each other as they approach the friction flap 450. In this way a portion of the third tab 450A proximate the friction flap 450 is wider than a portion of the third tab 450A proximate the main panel 412. The third tab 450A may be defined, at least in part, by a cut line 459 separating a portion of the third tab 450A from the friction flap 450. The cut line 459 may be linear. The third tab 450A is hingedly connected to central or medial portion of the main panel 412 as compared to the embodiments of FIG. 1 in which the friction flap 50 is hingedly connected to marginal or side portions of the main panel 12.

The third tooth or tab 450A may be flanked by a partial tooth or tab 458 on each side thereof.

The plurality of teeth 452, 452B, 454, 456, 458 of the first article retention structures RT3 are interrupted by a first recess or cutaway C1. The first recess C1 is provided at a location about the circumference of the first aperture A1 disposed in closest proximity to an adjacent second article retention structure RT2 and is disposed opposite the first second tooth 454. The first recess C1 extends from the first aperture A1 towards the second article retention structure RT2.

The first recess C1 may be flanked by a fourth tooth or tab 456 on each side thereof. Each fourth tooth or tab 456 may occupy a greater circumferential distance than one of the first teeth 452. Each fourth tooth 456 may be defined in part by a cutline 451 and by the first recess C1. The cutline terminates in a 'J' or 'C' shaped cut. The 'J' shaped cut may be arranged to curve toward the first recess C1.

Each of the pair of second teeth or engaging tabs 454 may be flanked by a sixth tooth or tab 452B on each side thereof. Each sixth tooth 452B is defined, in part, by a pair of cutlines 451, 457 each of which terminates in a 'J' or 'C' shaped cut. The 'J' shaped cuts may be arranged to curve toward each other that is to say converge towards each other as they extend away from the friction flap 450. A terminal ends of the 'J' shaped cut of cut line 451 extends towards the terminal end of the 'J' shaped cut of cut line 457.

Referring now to FIG. 18 there is shown a blank 410 in a stage of construction, a group of articles B have been received in the blank 410, and each is engaged by a respective one of the article retention structures RT2, RT3. The first and second end panels 424, 434 have been folded with respect to the main panel 412 and the first and second top end flaps 426, 436 have been folded to partially cover endmost articles B received in the blank 410. The friction flaps 450 have been displaced outwardly of the main panel 412 and lie over upper ends of the respective article B which displaced them. Each of the friction flaps 450 of the first article retention structures RT3 is held or retained at least in part by one of the first and second top end flaps 426, 436. A guide G is shown retaining the first and second top end flaps 426, 436 and the friction flaps 450 in a folded condition as the blank 410 is conveyed in the direction of travel, indicated by direction D1. The guide may form part of a packaging machine for assembly or construction of the blank 410 into a package comprising an article carrier 490 and a group of articles B. In this condition glue or other adhesive treatment may be applied to the upper surface of the friction flaps 450. The first top panel 418 may then be folded to be disposed over the articles B and at least a portion of the first and second top end flaps 426, 436 and the friction flaps 450. Glue or other adhesive treatment may be applied to an upper or outer surface of the first top panel 418 prior to folding the second top panel 420 into overlapping relationship therewith.

The connecting tabs 450A of the second article retention structures RT2 define a leading edge or portion of the friction flaps 450 as the blank 410 is conveyed through the packaging machine. This may prevent or inhibit the friction flap 450 becoming snagged or causing an obstruction to travel of the blank 410 in the packaging machine. This may be particularly advantageous in respect of the second article retention structures RT2 which are distal from first and second top end flaps 426, 436 and thus may have greater freedom of movement than the friction flaps 450 of the first article retention structures RT3 which are held by the first and second top end flaps 426, 436.

The blanks 10; 110; 210; 310; 410 include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27 point (pt.) SBS board (solid bleached sulphate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 210; 310; 410 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g., MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The present disclosure provides a carrier 90; 190; 290; 490 for engaging at least one article B. The article carrier 90; 190; 290; 490 comprises spaced apart panels 12, 18/20; 112, 118/120; 212, 218/220; 312, 318/320; 412, 418/420 including an upper panel 18/20; 118/120; 218/220; 318/320; 418/420 and a lower panel 12; 112; 212; 312; 412.

The article carrier 90; 190 may comprise a locking tab 60, 62; 160, 162 formed from the upper panel 18/20; 118/120. The locking tab 60, 62; 160, 162 provides a retaining device securing the upper panel 18/20; 118/120 in position above the lower panel 12; 112. At least a portion of the locking tab 60, 62; 160, 162 is disposed between the upper panel 18/20; 118/120 and the lower panel 12; 112 to maintain a spacing therebetween.

The article carrier 90; 190 may comprise a pair of locking tabs 60, 62; 160, 162 each formed from the upper panel 18/20; 118/120 and hinged thereto by a fold line 61, 63; 161, 163. The fold lines 61, 63; 161, 163 may be obliquely oriented with respect to a side edge of the panel 18/20; 118/120 in which it is defined. A first one of the pair of locking tabs 60, 62; 160, 162 is hinged to said panel 18/20; 118/120, by a first fold line 61, 161, in opposition to a second one of the pair of locking tabs 60, 62; 160, 162 is hinged to said panel 18/20; 118/120, by a second fold line 63, 163. The first fold line 61, 161 is parallel to the second fold line 63, 163.

The present disclosure also provides a carrier 90; 190 of the top engaging type having an engaging panel 12; 112 comprising article retention structures RT1, RT2 and a cover panel 18/20; 118/120 disposed over the engaging panel 12; 112 and spaced apart therefrom.

The carrier 90; 190; 290 may comprise an article retention structure RT1, RT2 having an annular series of engaging teeth or tabs 52, 54, 56, 58; 152, 154, 156, 158. The article retention structure RT1, RT2 may comprise a friction flap 50; 150, said friction flap 50; 150 being surrounded by the annular series of engaging teeth or tabs 52, 54, 56, 58; 152, 154, 156, 158. The article retention structure RT1, RT2 may comprise an aperture A1, A2 surrounded by the annular series of engaging teeth or tabs 52, 54, 56, 58; 152, 154, 156, 158. The friction flap 50; 150 is coupled to the engaging panel 12; 112 by at least one connecting tab 50A; 150B. The at least one connecting tab 50A; 150B may be located proximate a fold line 13, 15; 113, 115; between the engaging panel 12; 112 and a side panel 14, 16; 114, 116. The side panel 14, 16; 114, 116 may engage or contact the at least one connecting tab 50A; 150B encouraging the at least one connecting tab 50A; 150B towards or against an article in the article retention structure RT1. The friction flap 50; 150 may comprise at least one peripheral tab T1, T2. The friction flap 50; 150 may comprise two peripheral tabs T1, T2. A first peripheral tab T1 may be struck from the at least one connecting tab 50A; 150B. A second peripheral tab T2 may extend from the friction flap 50; 150 and interrupt the annular series of engaging teeth or tabs 52, 54, 56, 58; 152, 154, 156, 158 so as to define, at least in part a cutaway or recess C2. The first peripheral tab T1 may be defined by a "U" shaped cut line 59. The second peripheral tab T2 may be defined by a portion of an "H" shaped cut line 159. The first peripheral tab T1 may engage or contact the side panel 14, 16; 114, 116 to encourage the at least one connecting tab 50A; 150B towards or against an article B in the article retention structure RT1.

The carrier 90; 190; 290; 490 may comprise an article retention structure RT1, RT2; RT3 having an annular series of engaging teeth or tabs 52, 54, 56, 58; 152, 154, 156, 158; 352, 352B, 354, 354B, 356, 358, 358B; 452, 452B, 454, 456, 458. The article retention structure RT1, RT2; RT3 may comprise a friction flap 50; 150; 350A; 450A and/or an aperture A1, surrounded by the annular series of engaging teeth or tabs 52, 54, 56, 58; 152, 154, 156, 158; 352, 352B, 354, 354B, 356, 358, 358B; 452, 452B, 454, 456, 458. The friction flap 50; 150; 350; 450 is coupled to the engaging panel 12; 112; 312; 412 by at least one connecting tab 50A; 150B; 350A; 450A. The at least one connecting tab 50A; 150B; 350A; 450A may be located proximate a fold line 25, 35; 125, 135; 325, 335; 425, 435 between the engaging panel 12; 112; 312; 412 and an end panel 24, 34; 124, 134, 224; 234; 324; 334; 424, 434. The end panel 24, 34; 124, 134; 224, 234; 324, 334; 424, 434 may engage or contact the at least one connecting tab 50A; 150B; 350A; 450A encouraging the at least one connecting tab 50A; 150B; 350A; 450A towards or against an article B in the article retention structure RT1, RT2; RT3.

The friction flap 50; 150 may be coupled to the engaging panel 12; 112 by a pair of connecting tabs 150B. The pair of connecting tabs 150B may be spaced apart from each other by an article engaging tab 150C. The article engaging tab 150C may be defined by a second portion of the "H" shaped cut line 159.

The carrier 90; 190 may comprise an end closure structure 22A/28A/30A/24/26/30B/28B/22B, 32A/38A/40A/-34/36/40B/38B/32B; 122A/128A/130A/124/126/130B/128B/122B, 132A/138A/140A/134/136/140B/138B/132B. The end closure structure 22A/28A/30A/24/26/30B/28B/22B, 32A/38A/40A/34/36/40B/38B/32B; 122A/128A/-130A/124/126/130B/128B/122B, 132A/138A/140A/134/136/140B/138B/132B may comprises an end panel 24, 34; 124, 134 and a top end flap 26, 36; 126, 136 hingedly connected thereto. The end closure structure 22A/28A/30A/24/26/30B/28B/22B, 32A/38A/40A/34/36/40B/38B/32B; 122A/128A/130A/124/126/130B/128B/122B, 132A/138A/140A/134/136/140B/138B/132B comprises an article engaging structure comprising a cut line 3; 103 struck from the end panel 24, 34; 124, 134 and defining, at least in part, an article engaging opening OP having a first width dimension (1 and defining an engaging edge E3 in the end panel 24, 34; 124, 134. The end panel 24, 34; 124, 134 in the region of the engaging edge E3 arranged to brace against or support at least one of a plurality of engaging teeth or tabs 52, 54, 56, 58; 152, 154, 156, 158 of an adjacently disposed article retention structure RT1. The at least one of the plurality of engaging teeth or tabs 52, 54, 56, 58; 152, 154, 156, 158 having an engaging edge E1 having a second width dimension l2, the second width dimension 2 being less than the first width dimension l1. The at least one of the plurality of engaging teeth or tabs 52, 54, 56, 58; 152, 154, 156, 158 may be hinged to the engaging panel 12; 112 by a fold line 25, 35; 125, 135 hinging the end panel 24, 34; 124, 134 to the engaging panel 12; 112. The at least one of the plurality of engaging teeth or tabs 52, 54, 56, 58; 152, 154, 156, 158 may be defined by a pair of non-linear, optionally "J" shaped, cut lines 57; 157 spaced apart from the fold line 25, 35; 125, 135 hinging the end panel 24, 34; 124, 134 to the engaging panel 12; 112. The cut line 3; 103 may be non-linear and defines a cover tab T3 struck from the end panel 24, 34; 124, 134 and extending from the top end flap 26, 36; 126, 136. The cover tab T3 may be advantageous in that an upper end of the article B projecting through, or received in, the article engaging opening OP is covered or protected by the cover tab T3. In some embodiments, the end panel 24, 34; 124, 134 and the at least one of the plurality of engaging teeth or tabs 52, 54, 56, 58; 152, 154, 156, 158 may be arranged to be inclined with respect to the engaging panel 12; 112 at different angles of inclination.

The carrier 90; 190 may comprise a gusseted end closure structure 22A, 28A, 30A, 24, 26, 30B, 28B, 22B, 32A, 38A, 40A, 34, 36, 40B, 38B, 32B; 122A, 128A, 130A, 124, 126, 130B, 128B, 122B, 132A, 138A, 140A, 134, 136, 140B, 138B, 132B for forming a rigid hinged connection along at least one of upper and lower end edges of at least one end of a tubular structure formed in part by a cover panel 18/20; 118/120 and an engaging panel 12; 112 together with opposed side panels 14, 16; 114, 116.

The carrier 90; 190 may comprise a gusset provided by a pair of hinged panels 28A/30A, 28B/30B, 38A/40A, 38B/40B; 128A/130A, 128B/130B, 138A/140A, 138B/140B connecting between a first end flap 22A, 22B, 32A, 32B; 122A, 122B, 132A, 132B hingedly connected to an upper or cover panel 18/20; 118/120 and second end flap 24/26, 34/36; 124/126, 134/136 hingedly connected to a lower or engaging panel 12; 112.

The pair of hinged panels 28A/30A, 28B/30B, 38A/40A, 38B/40B; 128A/130A, 128B/130B, 138A/140A, 138B/140B may be hingedly connected to a portion 26, 36; 126, 136 of the second end flap 24/26, 34/36; 124/126, 134/136 arranged to be substantially parallel to the upper or cover panel 18/20; 118/12; and/or lower or engaging panel 12; 112.

The pair of hinged panels 28A/30A, 28B/30B, 38A/40A, 38B/40B; 128A/130A, 128B/130B, 138A/140A, 138B/140B may be recessed with respect to an end edge of the first end flap 22A, 22B, 32A, 32B; 122A, 122B, 132A, 132B or second end flap 24/26, 34/36; 124/126, 134/136.

At least one of the pair of hinged panels 28A/30A, 28B/30B, 38A/40A, 38B/40B; 128A/130A, 128B/130B, 138A/140A, 138B/140B may be defined, at least in part, by a pair of divergently arranged fold lines 31A, 41A; 131A, 141A.

At least one of the pair of hinged panels 28A/30A, 28B/30B, 38A/40A, 38B/40B; 128A/130A, 128B/130B, 138A/140A, 138B/140B may be defined, at least in part, by a pair of parallel fold lines 29A, 31A; 129A, 131A.

The cover panel 18/20; 118/120 may comprise a pair of cover flaps 18, 20; 118, 120 each of which is hingedly connected to the engaging panel 12; 112 by a respective side panel 14, 16; 114, 116.

The present disclosure also provides a carrier 290 of the top engaging type having an engaging panel 212 comprising article retention structures RT1, RT2 and a cover panel 218/220 disposed over the engaging panel 212 and spaced apart therefrom. The cover panel 218/220 comprises a first opening defined, at least in part, by a first locking tab 260 and a second opening defined, at least in part, by a second locking tab 262, the first opening being spaced apart from the second opening. The first locking tab 260 is hingedly connected to the cover panel 218/220 by a first fold line 261 and the second locking tab 260 is hingedly connected to the cover panel 218/220 by a second fold line 263, each of the first and second fold lines 261, 263 is obliquely oriented with respect to a side edge of the cover panel 218/220. The first fold line 261 is divergently arranged with respect to the second fold line 263. The first fold line 261 may be perpendicular to the second fold line 263. The cover panel 218/220 may be a composite panel formed from a pair of panels 218, 220 arranged in at least partial overlapping relationship with each other. One of the pair of panels 218, 220 may comprise the first locking tab 260 and the second locking tab 260. The other one of the pair of panels 218, 220 may comprises a receiver opening for receiving a respective one of the first and second locking tabs 260, 262. Each receiver opening may be defined, at least in part, by a receiver tab 260 each hingedly connected to the other one of the pair of panels 218, 220 by a respective one of a pair of fold lines 263, 265. A first one of the pair of fold lines 263, 265 is divergently arranged with respect to a second one of the pair of fold lines 263, 265. Each of the pair of fold lines 263, 265 is obliquely oriented with respect to a side edge of the other one of the pair of panels 218, 220.

The present disclosure also provides a carrier 490 having an engaging panel 312; 412 comprising two or more article retention structures RT1, RT2; RT3. The engaging panel 312; 412 having a pair of opposed side edges and a pair of end edges. The two or more article retention structures RT1, RT2; RT3 each having an article receiving opening including an annular series of engaging teeth or tabs 352, 352B, 354, 354B, 356, 358, 358B; 452, 452B, 454, 456, 458. Each of the two or more article retention structures RT1, RT2; RT3 may comprise a friction flap 50; 150; 350; 450 surrounded by the annular series of engaging teeth or tabs 352, 352B, 354, 354B, 356, 358, 358B; 452, 452B, 454, 456, 458. The friction flaps 350; 450 are coupled to the engaging panel 312; 412 by at least one connecting tab 50A; 150B; 350A; 450A. The at least one connecting tab 50A; 150B; 350A; 450A may be disposed about the article receiving opening of a respective one of the two or more article retention structures RT1, RT2; RT3 such that all the friction flaps 50; 150; 350; 450 of the two or more article retention structures RT1, RT2; RT3 fold in the same direction.

The friction flaps 50; 150; 350; 450 of the two or more article retention structures RT1, RT2; RT3 may fold towards the same side or end edge of the engaging panel 312; 412.

The engaging panel 312; 412 has a longitudinal axis y and a transverse axis x.

The two or more article retention structures RT1, RT2; RT3 are disposed in a linear series parallel to one of the longitudinal axis y and a transverse axis x.

The at least one connecting tab 50A; 150B; 350A; 450A may be disposed at or about a leading edge of the article receiving opening of each of the two or more article retention structures RT1, RT2; RT3 when being conveyed in a packaging machine.

The present disclosure also provides a carrier 490 having an engaging panel 312; 412 comprising two or more article retention structures RT1, RT2; RT3. The two or more article retention structures RT1, RT2; RT3 each having an article receiving opening including an annular series of engaging teeth or tabs 352, 352B, 354, 354B, 356, 358, 358B; 452, 452B, 454, 456, 458. Each of the two or more article retention structures RT1, RT2; RT3 may comprise a friction flap 50; 150; 350; 450 surrounded by the annular series of engaging teeth or tabs 352, 352B, 354, 354B, 356, 358, 358B; 452, 452B, 454, 456, 458. The friction flaps 50; 150; 350; 450 are coupled to the engaging panel 312; 412 by at least one connecting tab 50A; 150B; 350A; 450A. The at least one connecting tab 50A; 150B; 350A; 450A defines a proximal end of the friction flaps 50; 150; 350; 450. The proximal end of the friction flap 50; 150; 350; 450 of a first one of two or more article retention structure RT1, RT2; RT3 is disposed adjacent to a distal end of the friction flap 50; 150; 350; 450 of a second one of two or more article retention structure RT1, RT2; RT3, the distal end being disposed opposite the proximal end.

The present disclosure also provides a carrier 490 having an engaging panel 312; 412 comprising two or more article retention structures RT1, RT2; RT3. The two or more article retention structures RT1, RT2; RT3 each having an article receiving opening including an annular series of engaging teeth or tabs 352, 352B, 354, 354B, 356, 358, 358B; 452, 452B, 454, 456, 458. At least one of the annular series of engaging teeth or tabs 352, 352B, 354, 354B, 356, 358, 358B; 452, 452B, 454, 456, 458 may be defined, in part, by a pair of cutlines 351, 357; 451, 457 each of which terminates in a curvilinear cut, a 'J' or 'C' shaped cut. The 'J' shaped cuts may be arranged to curve toward each other, converging towards each other as they extend away from the friction flap 350; 450. A terminal end of the 'J' shaped cut of one of the pair of cutlines 351, 357; 451, 457 extends towards the terminal end of the 'J' shaped cut of the other one of the pair of cutlines 351, 357; 451, 457.

The present disclosure also provides a carrier 490 having an engaging panel 312; 412 comprising two or more article retention structures RT1, RT2; RT3. The two or more article retention structures RT1, RT2; RT3 each having an article receiving opening including an annular series of engaging teeth or tabs 352, 352B, 354, 354B, 356, 358, 358B; 452, 452B, 454, 456, 458. At least one of the annular series of engaging teeth or tabs 352, 352B, 354, 354B, 356, 358, 358B; 452, 452B, 454, 456, 458 may be defined, in part, by a cutline 351, 357; 451, 457, which terminates in a curvilinear cut, a 'J' or 'C' shaped cut, and in part by a cutaway or recess C1, C2, C3, C4. The 'J' shaped cut may be arranged to curve toward the cutaway or recess C1, C2, C3, C4, converging thereto as it extends away from the friction flap 350; 450.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for engaging at least one article, the article carrier comprising:

an engaging panel comprising an article retention structure configured to receive and support an article, the article retention structure comprising an article receiving opening with a plurality of engaging tabs, wherein the engaging panel comprises a pair of opposing ends and a pair of opposing sides, the pair of opposing ends being shorter than the pair of opposing sides; and an end closure structure comprising:

an end panel hingedly connected to an end of the engaging panel, and an article-engaging feature comprising an engaging edge for engagement with the article, wherein the engaging edge is provided by the end panel.

2. The article carrier of claim 1 wherein the end closure structure comprises a second end panel hingedly connected to an opposing end of the engaging panel, and the article engaging feature comprises a second engaging edge for engagement with the article, wherein the second engaging edge is provided by the second end panel.

3. The article carrier of claim 1 wherein the article engaging feature comprises a cutline formed at least in part on the end panel.

4. The article carrier of claim 3 wherein the cutline has a first width dimension and defining the engaging edge in the end panel, the end panel in the region of the engaging edge is arranged to brace against at least one of the plurality of engaging tabs of the article retention structure, and wherein the at least one of the plurality of engaging tabs has a second engaging edge having a second width dimension, the second width dimension L2 being less than the first width dimension L1.

5. The article carrier according to claim 3, wherein the cutline is non-linear and defines a cover tab struck from the end panel and extending from the top end flap.

6. The article carrier of claim 1 wherein at least one of the plurality of engaging tabs is hinged to the engaging panel by a joint proximate a fold line hinging the end panel to the engaging panel.

7. The article carrier of claim 1, wherein at least one of the plurality of engaging tabs is defined by a pair of non-linear cutlines spaced apart from a fold line hinging the end panel to the engaging panel.

8. An article carrier for engaging at least one article, the article carrier comprising an engaging panel comprising an article retention structure configured to receive and support an article, the article retention structure comprising an article receiving opening with a plurality of engaging tabs and a friction flap, the friction flap being at least partially surrounded by the engaging tabs, an end closure structure hingedly connected to the engaging panel, wherein the end closure structure comprises an end panel and a top end flap hingedly connected thereto;

an anchor flap hingedly connected to the top end flap, a top panel hingedly connected to the engaging panel, wherein at least a portion of each of the top panel, the anchor flap, the top end flap, and the friction flap overlap one another.

9. The article carrier of claim 8 wherein at least the portion of the friction flap, anchor flap, and top end flap interpose between the article and the top panel.

10. The article carrier of claim 8 wherein the engaging panel and the top panel are hingedly connected together by a side panel, wherein the friction flap is coupled to the engaging panel by at least one connecting tab, the at least one connecting tab is located proximate a fold line between the engaging panel and the side panel.

11. The article carrier of claim 10 wherein the side panel engages at least a part of the friction flap encouraging the at least one connecting tab towards or against an article in the article retention structure.

12. The article carrier of claim 10 wherein the side panel contacts the at least one connecting tab and encourages the at least one connecting tab against an article in the at least one article retention structure.

13. The article carrier of claim 8 wherein the friction flap comprises at least one peripheral tab for frictional engagement with an article in the article retention structure.

14. A blank foldable into a formed article carrier for engaging at least one article, the blank comprising:

an engaging panel comprising an article retention structure configured to receive and support an article, the article retention structure comprising an article receiving opening with a plurality of engaging tabs, and a friction flap, the friction flap being at least partially surrounded by the engaging tabs;

an end closure structure hingedly connected to the engaging panel, wherein the end closure structure comprises an end panel and a top end flap hingedly connected thereto; and a top panel hingedly connected to the engaging panel, wherein the top panel, the top end flap, and the friction flap are configured and arranged in the blank such that at least a portion of each overlaps one another in the formed article carrier.

15. The blank of claim 14, wherein the top panel comprises an anchor flap hingedly connected thereto, and wherein the anchor flap is disposed between the top panel and the top end flap in an overlapping relationship therewith in the formed article carrier.

16. The blank of claim 15 wherein the portion of the friction flap, anchor flap, and top end flap interpose between the article and the top panel in the formed article carrier.

17. The blank of claim 14 wherein the engaging panel and the top panel are hingedly connected together by a side panel, wherein the friction flap is coupled to the engaging panel by at least one connecting tab, the at least one connecting tab is located proximate a fold line between the engaging panel and the side panel.

18. The blank of claim 17 wherein the side panel engages at least a part of the friction flap encouraging the at least one connecting tab towards or against an article in the article retention structure in the formed article carrier.

19. The blank of claim 17 wherein the side panel contacts the at least one connecting tab and encourages the at least one connecting tab against an article in the at least one article retention structure in the formed article carrier.

20. The blank of claim 14 wherein the friction flap comprises at least one peripheral tab for frictional engagement with an article in the article retention structure in the formed article carrier.

* * * * *